United States Patent [19]

Derby et al.

[11] Patent Number: 4,479,243

[45] Date of Patent: Oct. 23, 1984

[54] COLLAPSIBLE RECEPTACLE WITH PREFABRICATED LIFT LOOPS AND METHOD OF MAKING

[75] Inventors: Norwin C. Derby; Robert R. Williamson, both of Dallas, Tex.

[73] Assignee: Super Sack Manufacturing Corporation, Dallas, Tex.

[21] Appl. No.: 467,445

[22] Filed: Feb. 17, 1983

Related U.S. Application Data

[63] Continuation-in-part of Ser. No. 376,004, May 7, 1982, abandoned, which is a continuation-in-part of Ser. No. 336,455, Dec. 31, 1981, which is a continuation-in-part of Ser. No. 281,406, Jul. 8, 1981, abandoned, which is a continuation of Ser. No. 46,822, Jun. 8, 1979, abandoned.

[51] Int. Cl.[3] ..... B65D 33/06; B65D 88/16

[52] U.S. Cl. ..... 383/24; 383/6; 383/109; 383/121; 493/210; 493/226; 493/926; 493/967

[58] Field of Search ..... 150/1, 12, 0.5, 55; 206/386, 595, 596; 294/152; 493/226, 221, 926, 210, 967; 383/6, 21, 22, 24, 32, 109, 121

[56] References Cited

U.S. PATENT DOCUMENTS

| | | | |
|---|---|---|---|
| 546,168 | 9/1895 | Lobdell . | |
| 616,249 | 12/1898 | Nickerson . | |
| 733,542 | 7/1903 | Converse . | |
| 1,308,263 | 7/1919 | Smith . | |
| 1,335,607 | 3/1920 | Salisbury . | |
| 1,815,106 | 7/1931 | Jostes . | |
| 1,910,789 | 5/1933 | Brady | 150/1 X |
| 2,009,511 | 7/1935 | Nydegger . | |
| 2,047,095 | 7/1936 | Booth . | |
| 2,096,161 | 10/1937 | Curran . | |
| 2,301,128 | 11/1942 | Landefeld . | |
| 2,314,876 | 3/1943 | Greene . | |
| 2,361,943 | 11/1944 | Issoglio et al. . | |
| 2,507,939 | 5/1950 | Smith . | |
| 2,691,998 | 10/1954 | Stucker . | |
| 2,740,445 | 4/1956 | Fornell . | |
| 2,969,102 | 1/1961 | Cunningham . | |
| 3,054,442 | 9/1962 | Atwood et al. | 493/226 X |
| 3,072,512 | 1/1963 | Dalle . | |
| 3,096,013 | 7/1963 | Kugler . | |

(List continued on next page.)

FOREIGN PATENT DOCUMENTS

| | | | |
|---|---|---|---|
| 523764 | 4/1931 | Fed. Rep. of Germany . | |
| 1092372 | 11/1960 | Fed. Rep. of Germany | 150/0.5 |
| 1913037 | 6/1971 | Fed. Rep. of Germany | 493/226 |
| 2505041 | 10/1975 | Fed. Rep. of Germany . | |
| 2512014 | 9/1976 | Fed. Rep. of Germany . | |
| 2141498 | 1/1973 | France . | |
| 266810 | 8/1929 | Italy . | |
| 413476 | 12/1966 | Switzerland . | |
| 9560 | of 1905 | United Kingdom . | |
| 339825 | 12/1930 | United Kingdom . | |
| 360733 | 11/1931 | United Kingdom . | |
| 867107 | 5/1961 | United Kingdom . | |
| 1097040 | 12/1967 | United Kingdom . | |
| 1177745 | 1/1970 | United Kingdom . | |
| 1317398 | 5/1973 | United Kingdom . | |
| 1340693 | 12/1973 | United Kingdom . | |
| 1468902 | 3/1977 | United Kingdom . | |

*Primary Examiner*—William Price
*Assistant Examiner*—Sue A. Weaver
*Attorney, Agent, or Firm*—Michael A. O'Neil

[57] ABSTRACT

In the construction of a collapsible receptacle there is provided a length of fabric material and a length of webbing material formed from the same material as the length of fabric material. A plurality of lift loops formed from length of webbing material are positioned at spaced points along the length of fabric material with the lower ends of the lift loops located more than a predetermined distance above the lower edge of the material. After the lift loops are secured to the length of fabric material, the assembly is secured around the upper end of a collapsible receptacle body panel with the lift loops projecting above the upper edge of the panel. A line of stitching is used to at least partially secure the assembly to the body panel, with the line of stitching positioned at least the predetermined distance below the lowermost end of the lift loops.

63 Claims, 54 Drawing Figures

U.S. PATENT DOCUMENTS 3,214,081 10/1965 Silverstein .
3,282,757 11/1966 Brussee .
3,328,226 6/1967 Wiley .
3,351,365 11/1967 Bickl .
3,374,929 3/1968 Silfverskiold .
3,424,067 1/1969 Blair ..... 493/926 X
3,430,815 3/1969 Weimer et al. .
3,445,055 5/1969 Port et al. .
3,531,365 9/1970 Melin .
3,540,356 11/1970 Lecomte .
3,570,749 3/1971 Sato et al. .
3,581,883 6/1971 Whitney .
3,589,506 6/1971 Ford et al. .
3,596,824 8/1971 Lehmacher et al. .
3,607,616 9/1971 Barbehenn et al. .
3,620,774 11/1971 Ford et al. .
3,623,937 11/1971 Gasaway .
3,661,322 5/1972 Norman .
3,666,585 5/1972 Barbehenn et al. .
3,671,383 6/1972 Sakata et al. .
3,701,559 10/1972 Marino et al. .
3,742,664 7/1973 Reding .
3,754,053 8/1973 Kray et al. .
3,754,063 8/1973 Schirmer .
3,789,897 2/1974 Saito .
3,798,115 3/1974 Hofmann et al. .
3,827,471 8/1974 Gregory et al. .
3,865,339 2/1975 Von Alven .
3,874,989 4/1975 Stange et al. .
3,893,595 7/1975 Khanna et al. .
3,961,655 6/1976 Nattrass et al. .
3,982,986 9/1976 Stone et al. .
4,010,784 3/1977 Nattrass et al. .
4,081,011 3/1978 Krause .
4,113,146 9/1978 Williamson .
4,143,796 3/1979 Williamson et al. .
4,194,652 3/1980 Williamson et al. .
4,221,250 9/1980 Manerba .
4,224,970 9/1980 Williamson et al. .
4,362,199 12/1982 Futerman ..... 150/12

COLLAPSIBLE RECEPTACLE WITH PREFABRICATED LIFT LOOPS AND METHOD OF MAKING

CROSS REFERENCE TO RELATED APPLICATIONS

This application is a continuation-in-part of copending U.S. patent application Ser. No. 376,004, filed May 7, 1982, now abandoned, which is a continuation-in-part of U.S. patent application Ser. No. 336,455, filed Dec. 31, 1981, which is a continuation-in-part of application Ser. No. 281,406, filed July 8, 1981, now abandoned, which in turn is a continuation of U.S. patent application Ser. No. 046,822 filed June 8, 1979, now abandoned.

TECHNICAL FIELD

This invention relates to a collapsible receptacle which is useful in handling flowable materials in semi-bulk quantities, and more particularly to such a receptacle wherein the lift loops are prefabricated for attachment to the upper end of the receptacle side wall.

BACKGROUND ART

The handling of particulate, granular or other flowable materials involves several problems. Such materials include chemicals, minerals, fertilizers, foodstuffs, grains, agricultural products and the like. Materials like these have generally been handled in two fashions.

Bulk handling equipment, including railroad cars, barges, trucks and the like, is employed when large quantities of material are required. Such bulk handling equipment, however, is of limited versatility. Only large quantities of materials can be handled efficiently, and only at those locations accessible to such equipment. In addition, sanitary standards are more difficult to maintain with bulk handling equipment because the materials are often exposed during at least part of the handling.

Container systems have been developed for handling relatively smaller quantities of material. The containers are individually filled, loaded for transportation to a point of distribution or use, unloaded, opened and emptied. Although containers can be more convenient in some respects, higher handling costs are usually incurred because less material is carried per container. The return freight costs of reusable containers can be substantial, particularly for rigid or noncollapsible containers.

There has been increasing interest in the use of flexible, collapsible containers for handling semi-bulk quantities of materials. The advantages of such receptacles include relatively low weight, reduced cost, better versatility, and low return freight costs in the case of reusable receptacles. One disadvantage of some flexible receptacles, however, is that they are not self-supporting and must therefore be handled with the aid of pallets or the like. Other flexible receptacles incorporate external sling assemblies for purposes of self-support. Two successful examples of receptacles with external sling constructions can be found in U.S. Pat. Nos. 4,113,146 and 4,143,796 to Williamson and Williamson and Derby, respectively. In other instances collapsible receptacles with integral sling structures, i.e., lift loops, have not exhibited adequate strength, particularly when a single lift loop is required to support the entire load contained by the receptacle.

DISCLOSURE OF INVENTION

The present invention comprises a collapsible receptacle which overcomes the foregoing and other difficulties associated with the prior art. The invention comprises a new and improved collapsible receptacle for handling materials in semi-bulk quantities. The receptacle features top loading and bottom discharge. The receptacle can be used with virtually any flowable material, including minerals, chemicals, fertilizers, foodstuffs, agricultural products and the like. The receptacle of the present invention can be sized to handle from about six to eighty-four cubic feet of material, or up to about 3,000 pounds by weight. The construction of the receptacle functions as an integral sling, whereby an external sling assembly is neither desirable nor necessary. The invention lends itself to simplified construction, and is therefore less expensive than collapsible receptacles incorporating external sling assemblies.

More specifically, the present invention comprises a collapsible receptacle with a built-in sling. The receptacle is formed primarily of rectangular panels of flexible but substantially inextensible material. Woven polypropylene or woven polyethylene materials can be utilized in constructing the invention. The receptacle may include a number of side panels, two of which are relatively longer than the other side panels. The side panels are arranged and secured together along the side edges thereof. The longer side panels are folded back and secured to themselves to form opposing lift loops or sleeves extending substantially the width of the receptacle. A bottom panel is secured between the bottom edges of the side panels, while a top panel with a fill spout therein is secured between the top edges of the side panels. If desired, a discharge spout can be mounted in the bottom panel.

In another embodiment of the invention, reinforced material is utilized for the two side panels having the lift sleeves at the tops thereof. The reinforced material comprises woven polypropylene or woven polyethylene with continuous longitudinal strands of polyester woven directly therein. The reinforcing polyester strands can be provided in the material as selvage or bands.

In another aspect of the invention, a combination top/bottom panel assembly can be used in constructing the receptacle. The assembly includes a panel with an opening positioned centrally therein. The opening is preferably oblong or oval in shape and is at least as wide in the long direction as the maximum bridging distance of the material being handled. A spout is positioned in the opening and secured to the panel. The assembly can be used in this form as a top panel for the receptacle. To convert to a bottom panel construction, a closure assembly is secured to the panel about the spout.

In yet another embodiment of the invention, the receptacle is formed from a single piece of material. Preferably, a receptacle blank is formed by making predetermined cutouts through a length of flattened circular or tubular material. The forward and trailing ends of the receptacle blank correspond so that blanks can be cut sequentially from an advancing supply of tubular material without waste. Openings for the fill and discharge spouts are cut into the receptacle blank as desired. The blank is then folded and secured to form a collapsible receptacle with an integral sling.

In still another embodiment of the invention, the receptacle is formed of at least one sheet of flexible material having two side edges and top and bottom edges with a generally rectangular shape. The material is folded along first parallel folds proximate its center to define a first side panel between the top and bottom edges and first folds. The material is further folded along second and third parallel folds on either side of the first folds to form second and third side panels on either side of the first panel formed of opposed pairs of collapsible halves. Structure is provided for fastening the side edges of the sheet of material between the third folds to form a fourth side panel opposed to the first panel, the sheet being collapsible to a flat form for storage and expandable to form a rectangular tube.

In accordance with another aspect of the present invention, the collapsible receptacle further includes structure for securing together the panels along the first and third folds proximate the top edge along a line angled toward the top edge from the fold to form a closure at the top end having a generally rectangular shaped hole therethrough. Flaps are formed upstanding from the line of securement by facing portions of the secured sides. A carrying strap may be secured between flaps on the material to permit the sheet of flexible material to be supported therefrom. Reinforcing material may be secured to the carrying strap, flaps and along the adjacent fold to reinforce the receptacle.

In accordance with yet another aspect of the present invention, a method is provided for forming a collapsible receptacle for handling flowable material from a sheet of flexible material having side edges and a top and bottom edge. The method includes the steps of folding the material along first parallel folds proximate the center of the sheet to form a first side panel between the first folds and top and bottom edges. The method further includes the step of folding the material along second and third parallel folds on both sides of the first folds opposite the first panel to form second and third sides, each of the second and third sides formed of adjacent panel halves foldable into facing relation. The method further includes the step of fastening the ends of the sheet together along the side edges to form a fourth side panel opposed to the first side panel, the sheet being foldable to a flattened form and expandable to a rectangular tube. The method concludes with the step of fastening adjacent panels along the first and second folds along lines extending between the folds and top edges to form a top having a rectangular hole therethrough, the adjacent side panels forming flaps extending from the top for lifting the receptacle.

In accordance with yet another embodiment of the invention there is provided a prefabricated structure comprising lift loops for supporting the receptacle and its contents. The prefabricated lift loop structure is then secured to the upper end of the side wall of the receptacle. If desired, the receptacle may be provided with a bottom wall incorporating lift fork receiving members.

BRIEF DESCRIPTION OF DRAWINGS

A more complete understanding of the invention can be had by reference to the following Detailed Description in conjunction with the accompanying Drawings, wherein.

Figure 7:
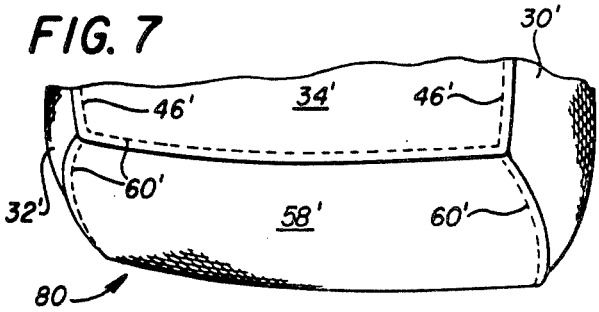
Figure 8:
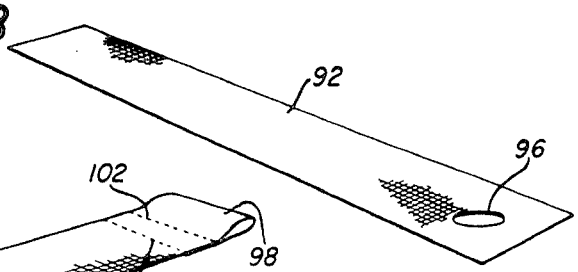
Figure 9:
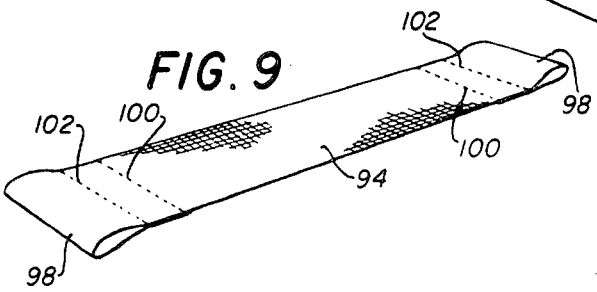
Figure 12:
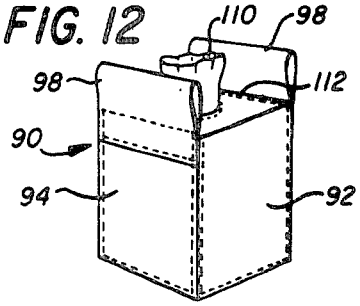
Figure 13:
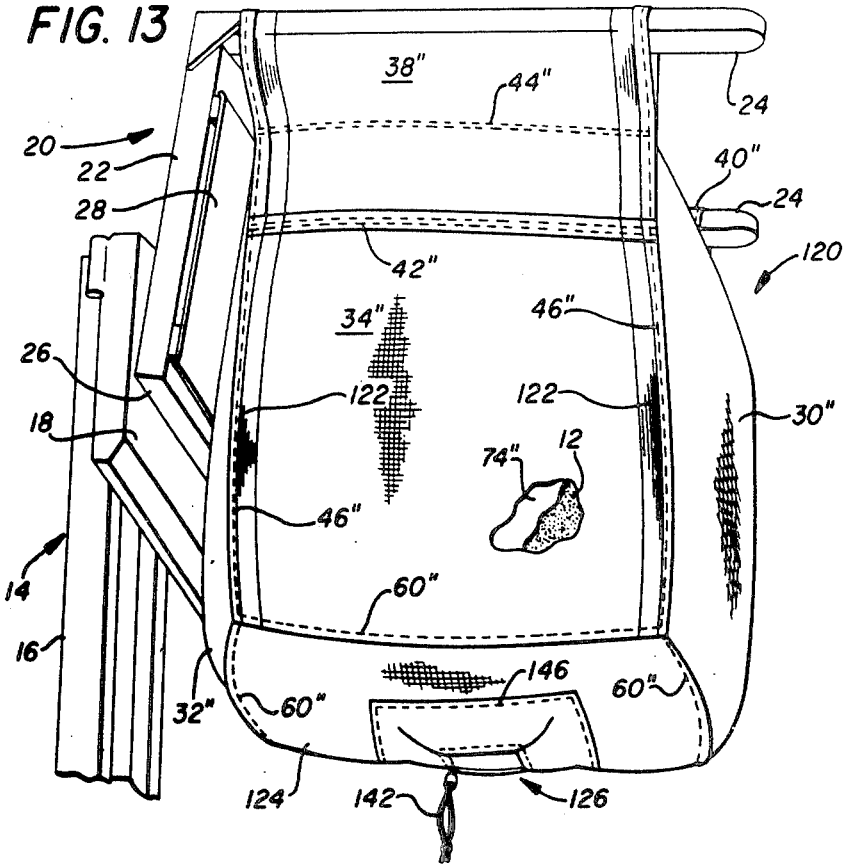
Figure 14:
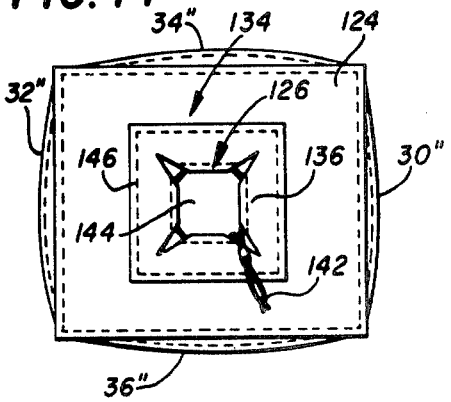
Figure 15:
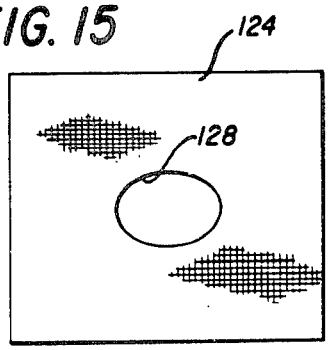
Figure 23:
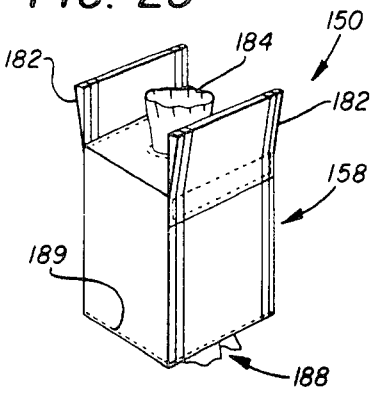
Figure 24:
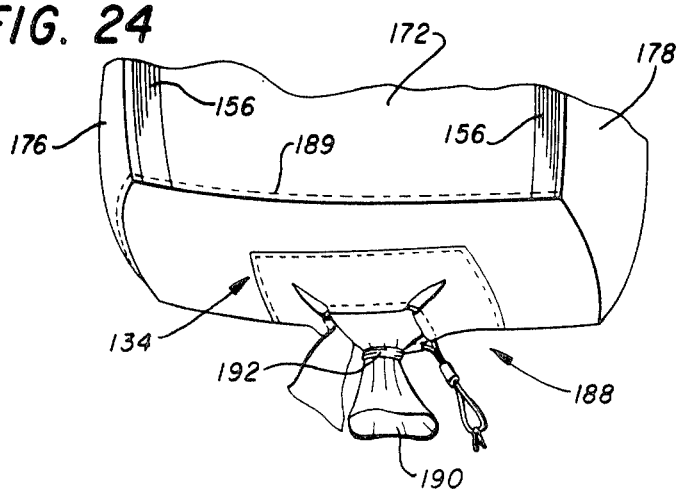
Figure 25:
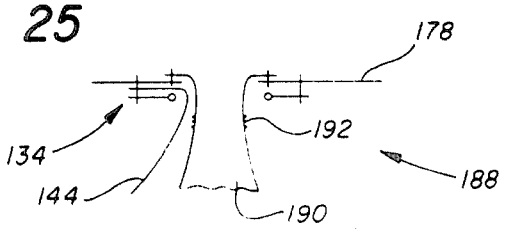
Figure 26:
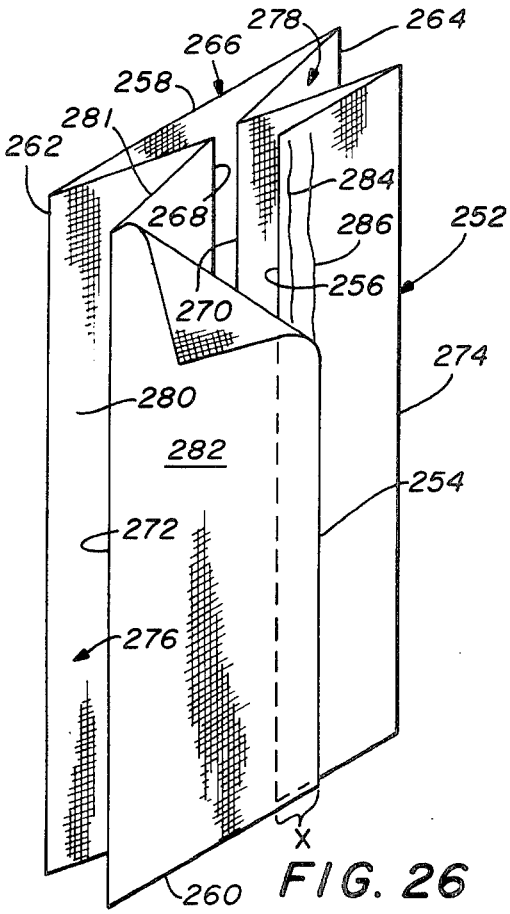
Figure 27:
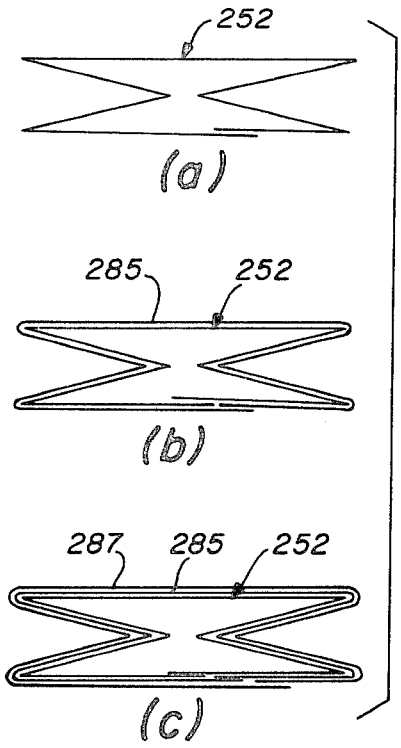
Figure 29:
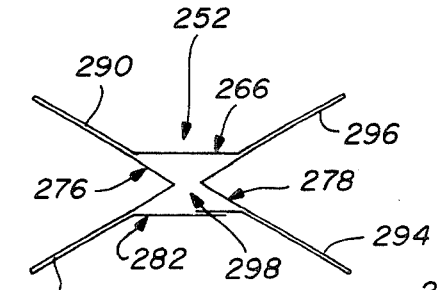
Figure 30:
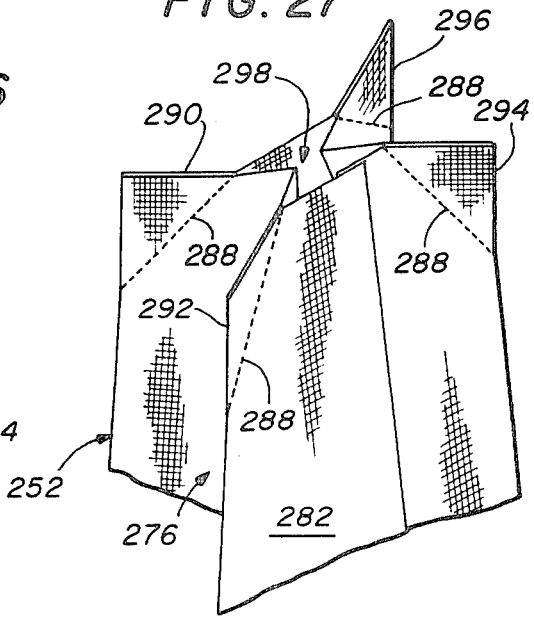
Figure 28:
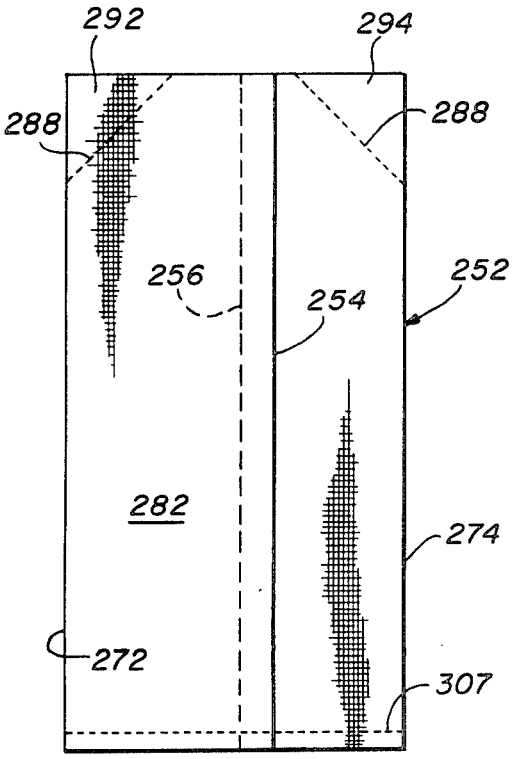
Figure 31:
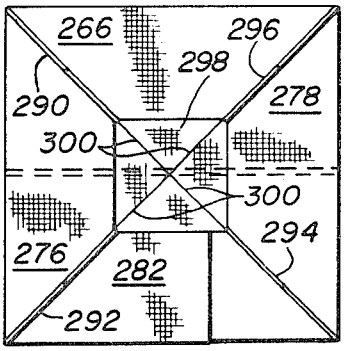
Figure 32:
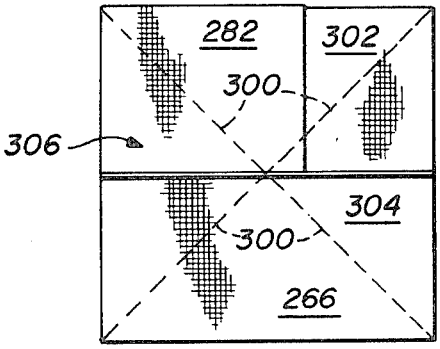
Figure 33:
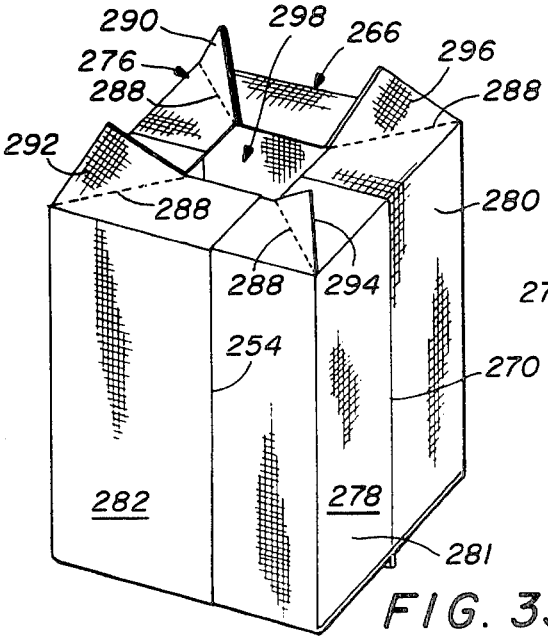
Figure 34:
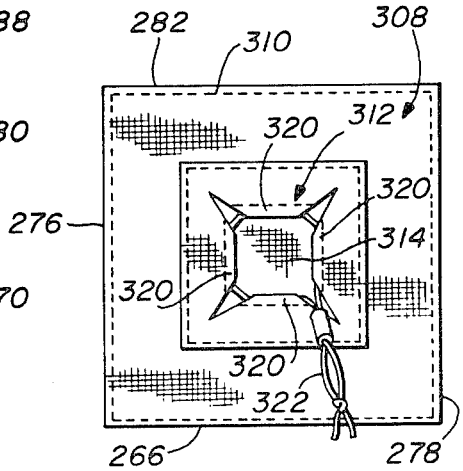
Figure 35:
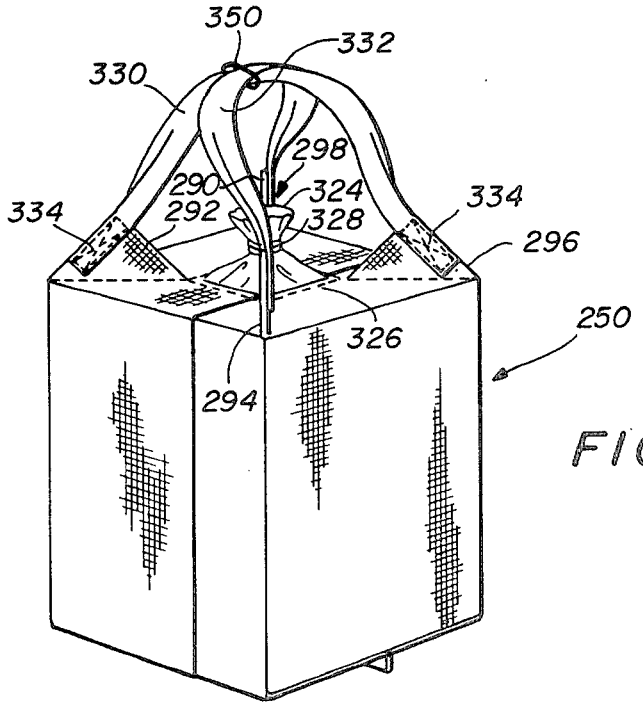
Figure 36:
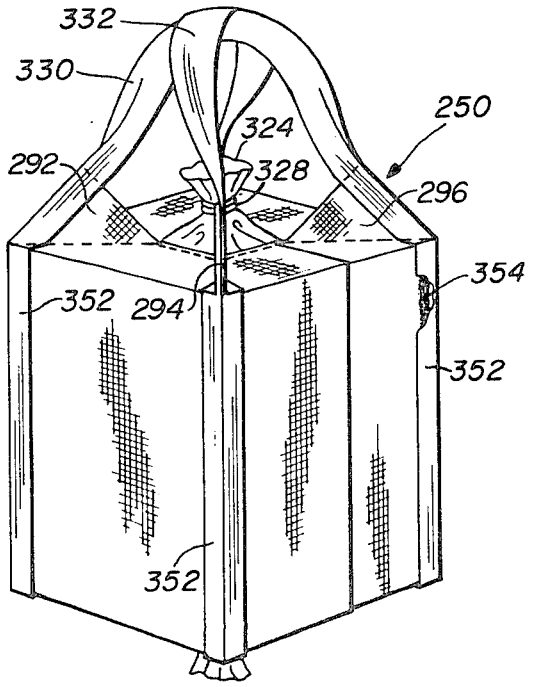
Figure 37:
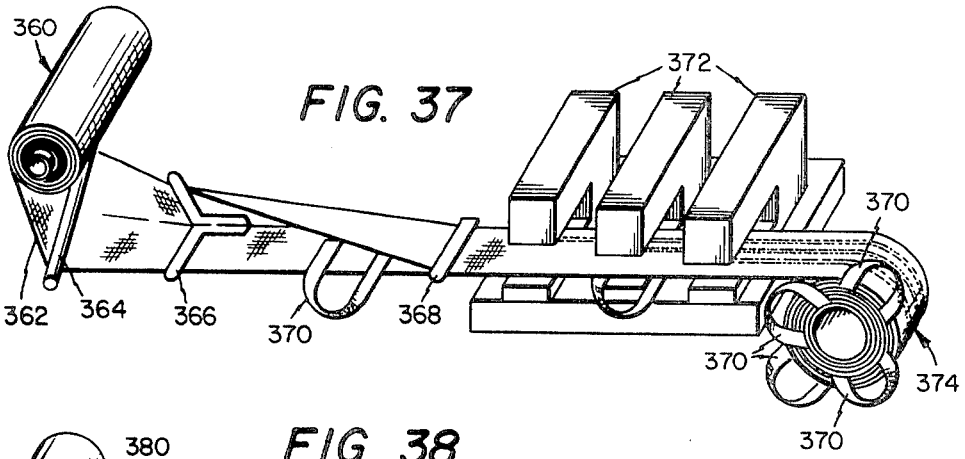
Figure 38:
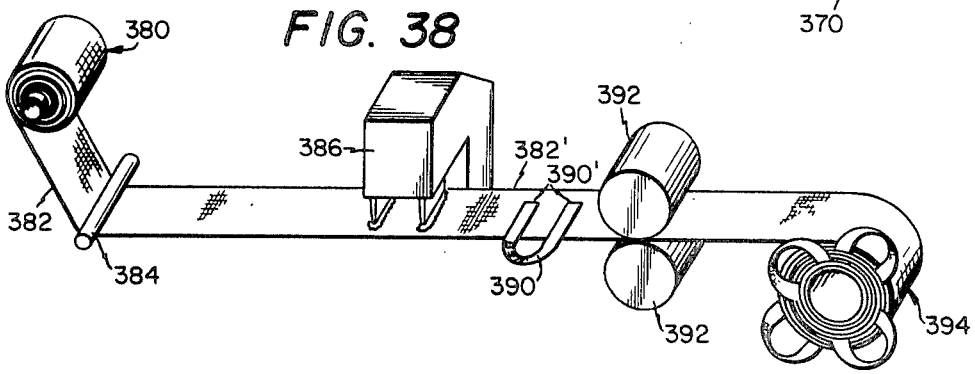
Figure 39:
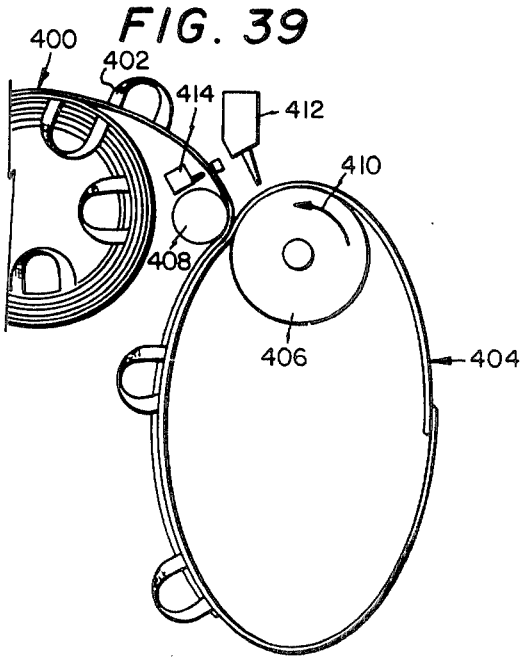
Figure 40:
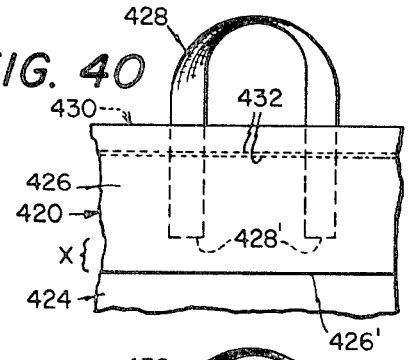
Figure 41:
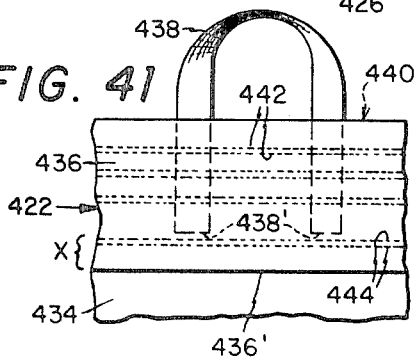
Figure 42:
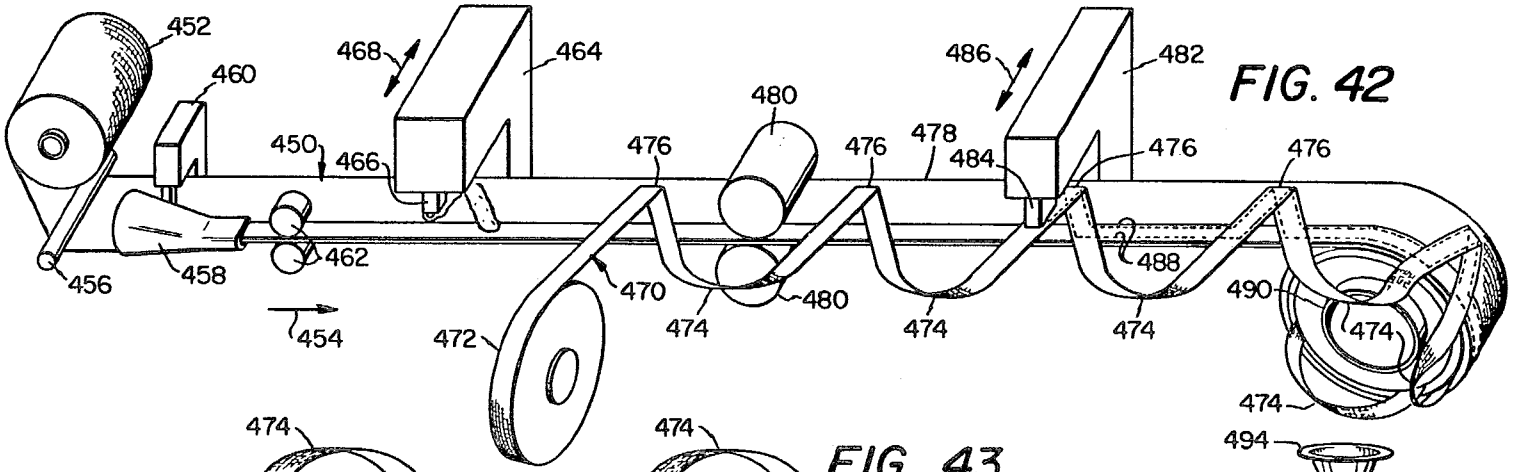
Figure 46:
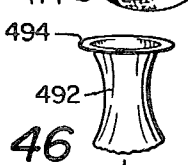
Figure 46:
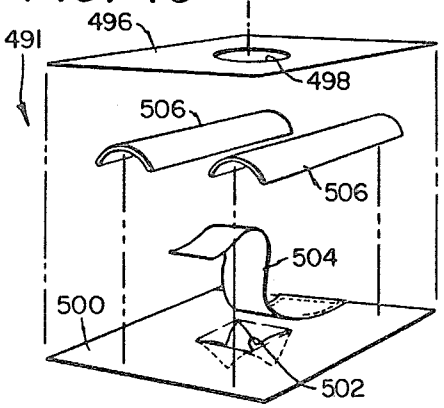
Figure 43:
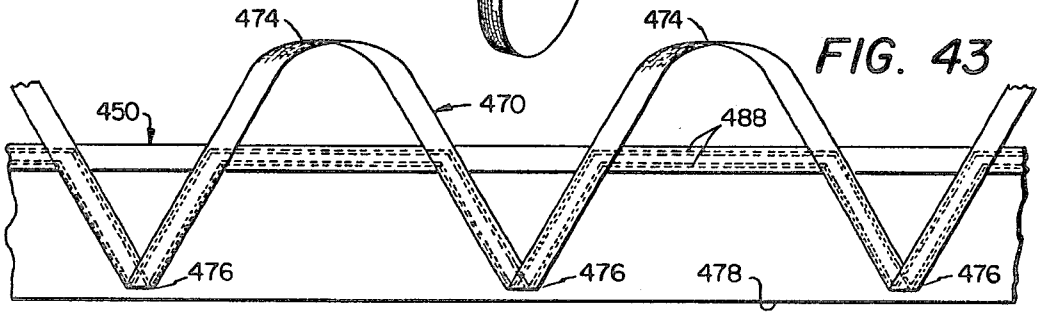
Figure 44:
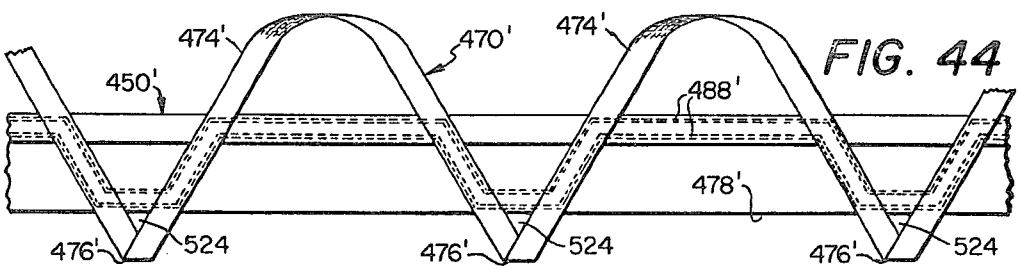
Figure 47:
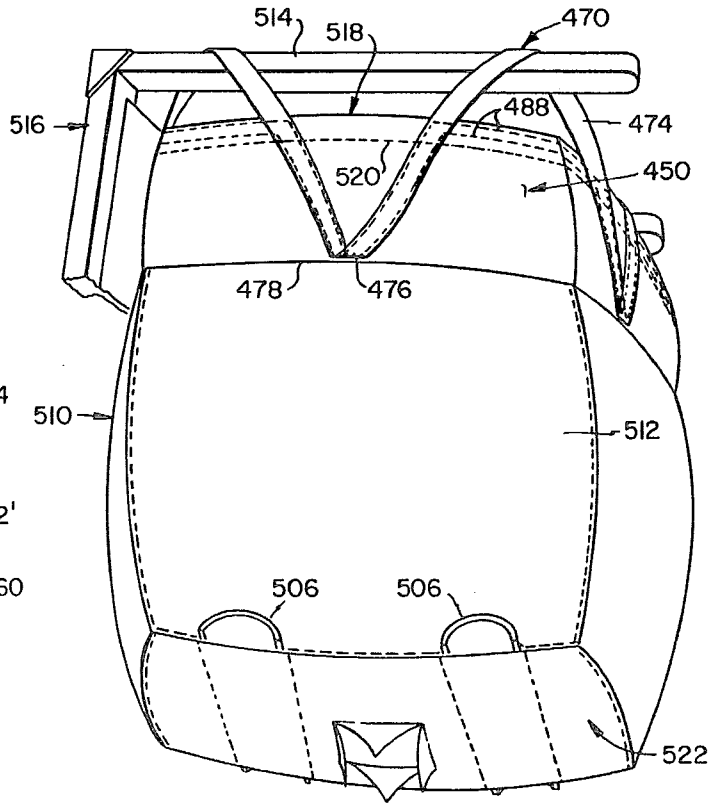
Figure 45:
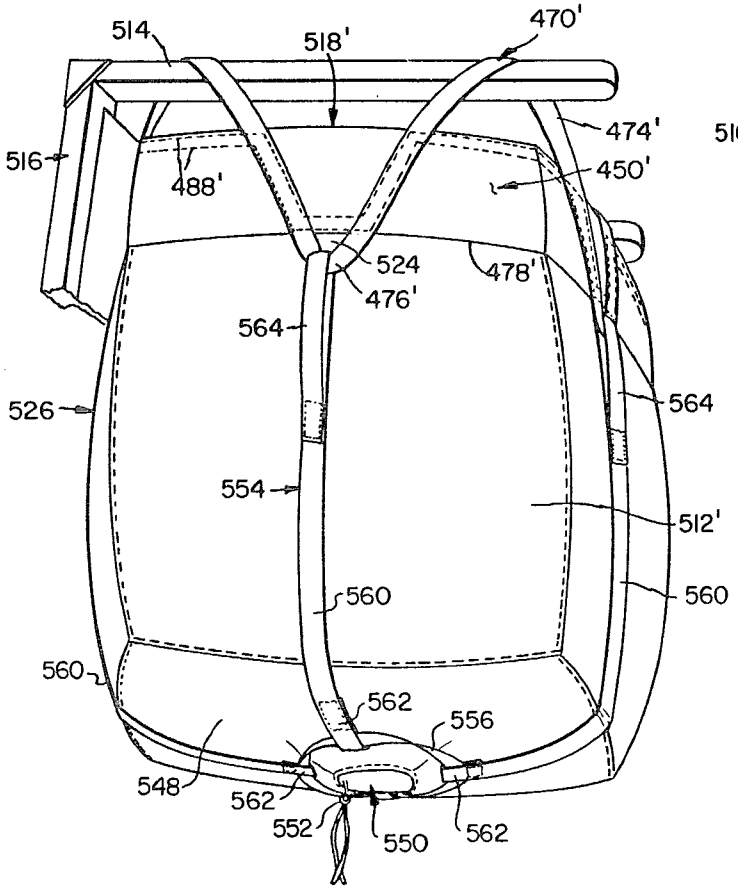
Figure 48:
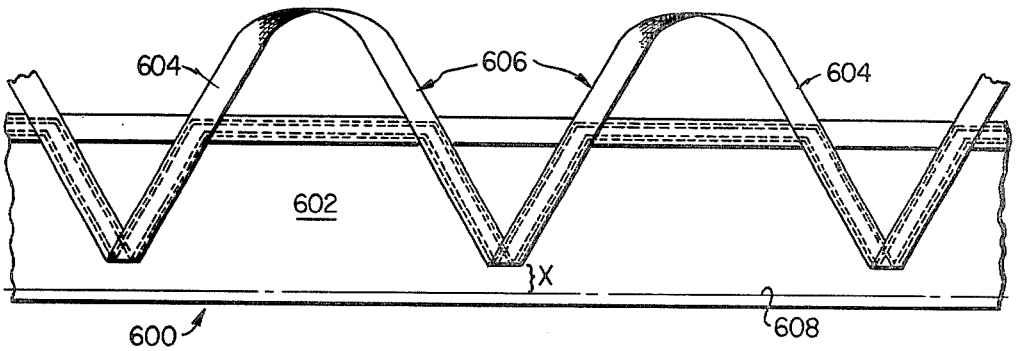
Figure 49:
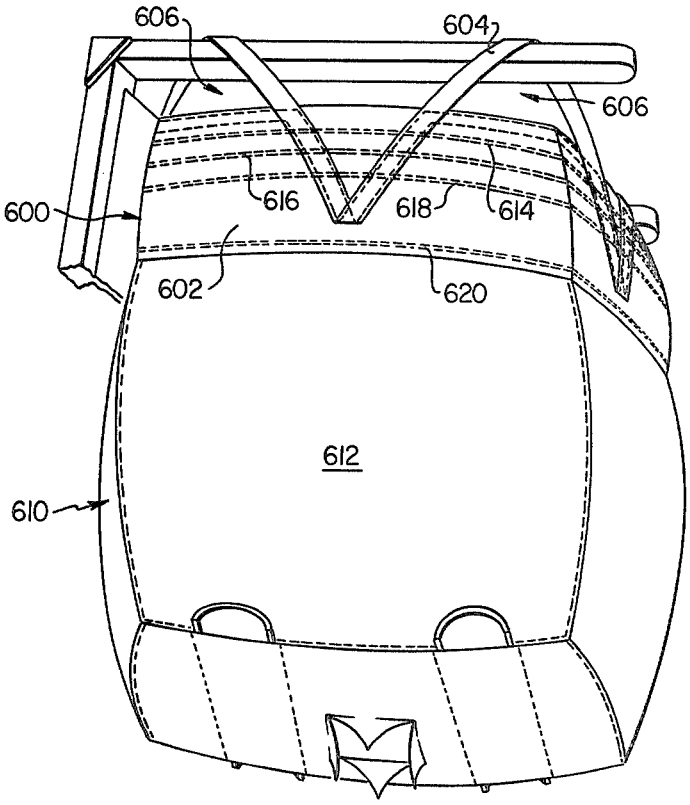

FIGS. *6a, 6b, 6c* and *6d* are diagrams of four types of seams utilized in constructing the invention;

FIG. 7 is a partial bottom side perspective view of a collapsible receptacle incorporating a second embodiment of the invention;

FIGS. 8–11 illustrate steps in constructing a third embodiment of the invention;

FIG. 12 is a perspective illustration of a collapsible receptacle incorporating the third embodiment of the invention;

FIG. 13 is a bottom side perspective view of a collapsible receptacle incorporating a fourth embodiment of the invention;

FIG. 14 is a bottom view of the receptacle shown in FIG. 13;

FIGS. 15–18 are detail illustrations showing construction of the bottom receptacle panel;

FIGS. 19–22 illustrate steps in constructing a fifth embodiment of the invention;

FIG. 23 is a perspective illustration of a collapsible receptacle incorporating the fifth embodiment of the invention;

FIG. 24 is a partial perspective view of the receptacle shown in FIG. 23 with the discharge spout assembly extended;

FIG. 25 is a diagrammatic vertical section view through the extended discharge spout assembly of FIG. 24;

FIG. 26 is a top side perspective view of a collapsible receptacle incorporating a sixth embodiment of the invention;

FIGS. *27a, 27b* and *27c* are top views of the collapsible receptacle shown in FIG. 26 formed of different numbers of layers of material;

FIG. 28 illustrates in a side view a step in constructing the collapsible receptacle incorporating the sixth embodiment;

FIG. 29 is a top view of the collapsible receptacle incorporating the sixth embodiment of the invention;

FIG. 30 is a top side perspective view of another step in constructing the sixth embodiment of the invention;

FIG. 31 is a top view of the collapsible receptacle incorporating the sixth embodiment;

FIG. 32 is a bottom view of one form of bottom used with the sixth embodiment;

FIG. 33 is a top side perspective view of the sixth embodiment of the invention;

FIG. 34 is a bottom view of another bottom for use with the sixth embodiment;

FIG. 35 is a top side perspective view of the collapsible receptacle of the sixth embodiment with carrying straps; and FIG. 36 is a top side view of the collapsible receptacle of the sixth embodiment having reinforcing material;

FIG. 37 is a schematic illustration of a first method of securing lift loops to a length of fabric material;

FIG. 38 is a schematic illustration of a second method of securing lift loops to a length of fabric material;

FIG. 39 is a schematic illustration of a method of adhesively securing a length of fabric material having lift loops previously secured thereto to a collapsible receptacle body panel;

FIG. 40 is an illustration of a collapsible receptacle made in accordance with FIGS. 38 and 39;

FIG. 41 is an illustration of a collapsible receptacle made in accordance with FIGS. 37 and 39;

FIG. 42 is a schematic illustration of a third method of securing lift loops to a length of fabric material;

FIG. 43 is an illustration of a prefabricated lift loop structure made in accordance with FIG. 42;

FIG. 44 is an illustration of an alternative lift loop structure;

FIG. 45 is an illustration of a collapsible receptacle incorporating the prefabricated lift loop structure of FIG. 44;

FIG. 46 is an illustration of an embodiment of the invention comprising an improved bottom wall construction;

FIG. 47 is an illustration of a collapsible receptacle incorporating the prefabricated lift loop structure of FIG. 43 and the bottom wall construction of FIG. 46;

FIG. 48 is an illustration of a lift loop assembly similar to that of FIG. 43; and FIG. 49 is an illustration of a collapsible receptacle incorporating the lift loop structure of FIG. 48.

DETAILED DESCRIPTION

Figure 1:
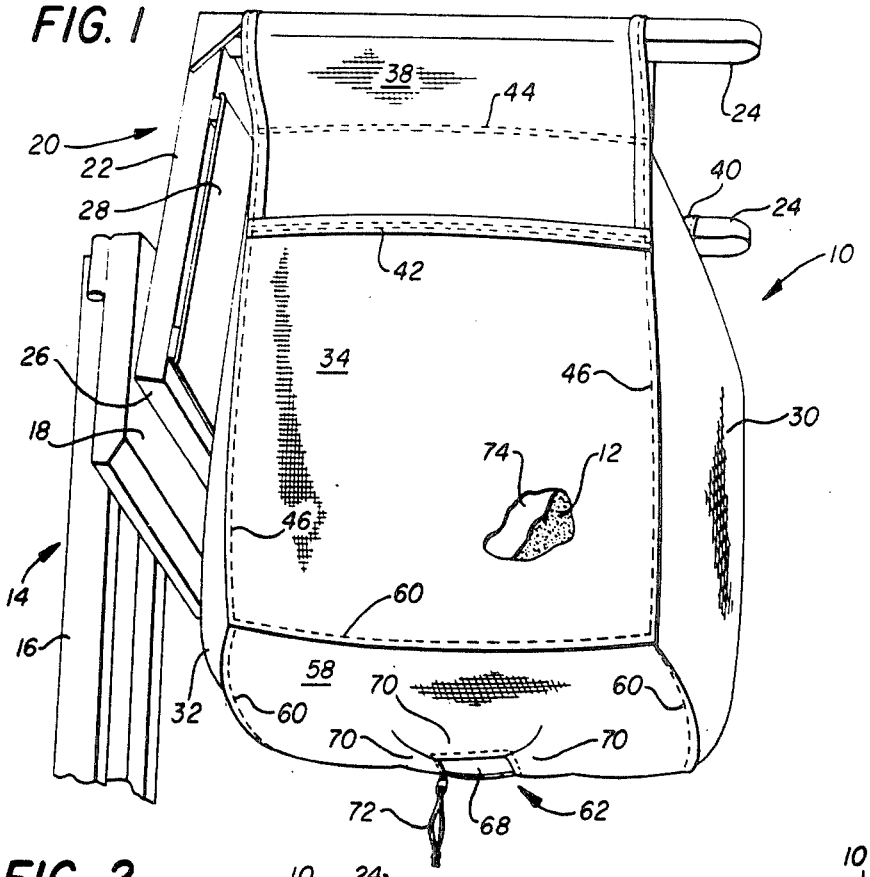
FIG. 1 is a bottom side perspective view of a collapsible receptacle incorporating a first embodiment of the invention.

Referring now to the Drawings, wherein like reference numerals designate like or corresponding parts throughout the several views, and particularly referring to FIG. 1, there is shown a receptacle 10 incorporating a first embodiment of the invention. The receptacle 10 is of flexible, collapsible construction and is useful in handling semi-bulk quantities of material 12. For example, material 12 can comprise minerals, chemicals, fertilizers, foodstuffs, agricultural products or the like.

A forklift assembly 14 supports the receptacle 10 in FIG. 1. Forklift assembly 14 includes a mast 16 on a conventional forklift vehicle (not shown). Mast 16 supports a cross member 18 which is vertically moveable along the mast. Other loading vehicles having different types of lift assemblies can also be utilized.

A fork attachment 20 is connected to the cross member 18. Attachment 20 includes two vertical columns 22 and arms 24 extending outwardly from the upper ends of the columns 22. A plate 28 is secured over crossbars 26. Portions of receptacle 10 are received over arms 24 for support by fork attachment 20.

If desired, receptacle 10 can be lifted and carried by a crane or the like using an attachment having arms similar to arms 24 in fork attachment 20. Receptacle 10 is self-supporting, and no external sling assemblies or pallets are required to handle the receptacle.

Figure 2:
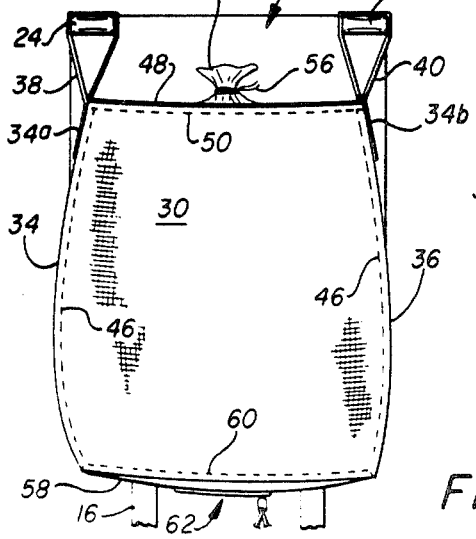
FIG. 2 is a reduced front view of the receptacle shown in FIG. 1.
Figure 3:
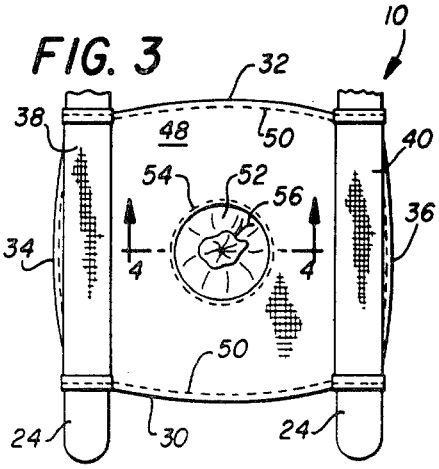
FIG. 3 is a reduced top view of the receptacle shown in FIG. 1.

Constructional details of receptacle 10 are shown in FIGS. 1, 2 and 3. Receptacle 10 comprises front and back side panels 30 and 32, and left and right side panels 34 and 36. Side panels 30, 32, 34 and 36 are all generally rectangular. In accordance with the preferred construction of receptacle 10, side panels 34 and 36 are relatively longer than side panels 30 and 32. The upper ends of side panels 34 and 36 are folded back and secured to themselves to form lift sleeves 38 and 40, respectively. Lift sleeves 38 and 40 thus extend the entire width of side panels 34 and 36, respectively.

In particular, the formation of lift sleeves 38 and 40 proceeds as follows. Each lift sleeve 38 and 40 is formed similarly. With respect to panel 34, the top edge thereof is secured by stitching 42 extending across the panel. Preferably, a second line of stitching 44 is provided across panel 34 above stitching 42. If desired, the top and side edges of panel 34 can be folded inward before provision of stitching 42 and 44 for extra reinforcement of these areas in receptacle 10. It has been found that the two lines of stitching 42 and 44 create a truss-like effect, which is more effective in distributing load between lift sleeve 38 and receptacle 10. Lift sleeve 40 in side panel 36 is formed in similar fashion. It will thus be understood that lift sleeves 38 and 40 extending across the entire width of receptacle 10 are formed directly in an opposing pair of side panels.

The side panels 30, 32, 34 and 36 are joined at the side edges thereof to form an upstanding sidewall in receptacle 10. The side edges of the panels are connected by sewn seams 46. Seams, such as plain seams wherein adjacent panels are joined by stitching along a line positioned inwardly from the free edges of the panels, can be used to interconnect each panel 30, 32, 34 and 36 to an adjacent panel. Other suitable types of seams 46 can also be used, if desired. The side panels 30, 32, 34 and 36 are thus interconnected by longitudinal seams 46 extending along the length thereof.

A top panel 48 is secured between the upper ends of side panels 30, 32, 34 and 36. Panel 48 can be of rectangular or square configuration. Panel 48 is secured about the periphery thereof to side panels 30, 32, 34 and 36 by means of stitching 50. A fill spout 52 is mounted in an opening provided centrally in the top panel 48. The spout 52 is generally cylindrical, and is secured by stitching 54 about the circumference of one end to panel 48. A wire tie 56 or other suitable device can be employed to close fill spout 52. It will thus be apparent that flowable material 12 is introduced into receptacle 10 through fill spout 52.

Figure 5:
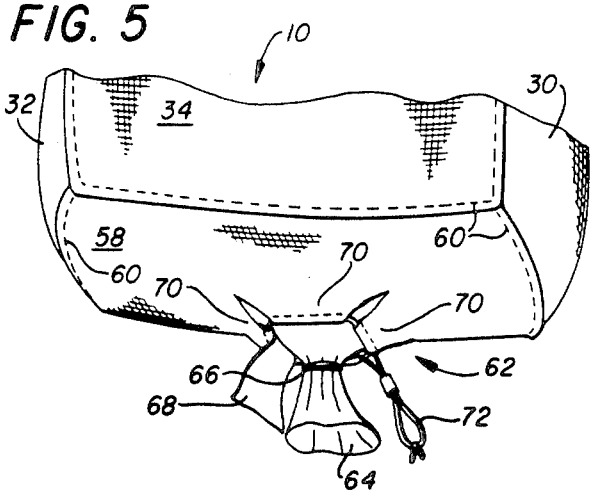
FIG. 5 is a partial perspective view of the bottom of the receptacle shown in FIG. 1 with the discharge spout assembly extended.

Referring now to FIGS. 1, 2 and 5, a bottom panel 58 closes the lower end of receptacle 10. Bottom panel 58 is secured about the periphery thereof by stitching 60 to the bottom edges of panels 30, 32, 34 and 36. The bottom panel 58 includes a discharge spout assembly 62. Discharge spout assembly 62 is substantially identical to the discharge spout assembly 70 illustrated and described in U.S. Pat. No. 4,143,796, the disclosure of which is herein incorporated by reference.

FIG. 1 illustrates discharge spout assembly 62 in the closed position, while FIG. 5 illustrates the assembly in the open and extended position. Briefly, discharge spout assembly 62 includes a spout 64 connected to an opening in bottom panel 58. Spout 64 is closed with a wire tie 66. When not in use spout 64 can be rolled up, covered with flap 68, and closed inside assembly 70 by draw cord 72.

Collapsible receptacle 10 can be constructed of any suitably strong material which is flexible but substantially inextensible. Natural or synthetic woven material can be employed. Jute, cotton, polyethylene, or polypropylene are examples of such materials. It has been found that woven polypropylene material is advantageous because of its strength, durability and puncture resistance. An impermeable liner 74, shown in FIG. 1, can be provided inside receptacle 10, if desired. Liner 74 would be advantageous when handling footstuffs, fine powdered materials, or moist materials. Polybutylene film, for instance, can be used for liner 74.

Figure 6A:
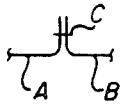
Figure 6B:
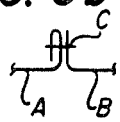
Figure 6C:
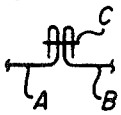
Figure 6D:
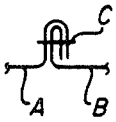

FIGS. 6*a*, 6*b*, 6*c* and 6*d* are detailed illustrations of seams which can be employed in connecting adjacent panels in receptacle 10. FIG. 6*a* comprises a plain seam wherein single layers of panels A and B are connected by stitching C. In FIG. 6*b* a double layer of panel A is secured to a single layer of panel B. Double layers of panels A and B are interconnected in FIGS. 6*c* and 6*d*. Panels A and B in these detailed illustrations represent any pair of adjacent panels in receptacle 10. If desired the outside edges of panels A and B can be fused or adhesively secured together to minimize leakage.

FIG. 7 partially illustrates a second embodiment of the invention. Various components of collapsible receptacle 80 are substantially identical in construction and function to components of collapsible receptacle 10 shown in FIGS. 1–5. Such identical components are designated in FIG. 7 with the same reference numerals, but are differentiated therefrom by means of a prime (′) designation.

The primary distinction comprises the fact that receptacle 10 does include a discharge spout assembly, whereas receptacle 80 does not include a discharge spout assembly, whereas receptacle 10 includes spout assembly 62. Bottom panel 58′ in receptacle 80 simply comprises a square or rectangular section of material. Discharge of flowable materials from receptacle 80 is accomplished by puncturing bottom panel 58′. Receptacle 80 is thus best suited for material handling applications wherein reuse of the receptacle is not contemplated. Though illustrated only partially, receptacle 80 is substantially identical to receptacle 10 in all other respects.

FIGS. 8–11 illustrate the steps involved in constructing the collapsible receptacle 90 shown in FIG. 12. Receptacle 90 comprises a third embodiment of the present invention. Receptacle 90 is formed from two panels 92 and 94 each having the configuration of an elongate rectangle. Panels 92 and 94 comprise suitable natural or synthetic material, such as woven polypropylene or woven polyethylene. Panel 92 includes an opening 96 near one end thereof. Panel 94 includes loops or sleeves 98 formed at the ends thereof. Sleeves 98 in panel 94 are formed by folding back and securing the ends of the panel with stitching 100. Preferably, a second line of stitching 102 is provided between stitching 100 and the end of each sleeve 98.

Figure 10:
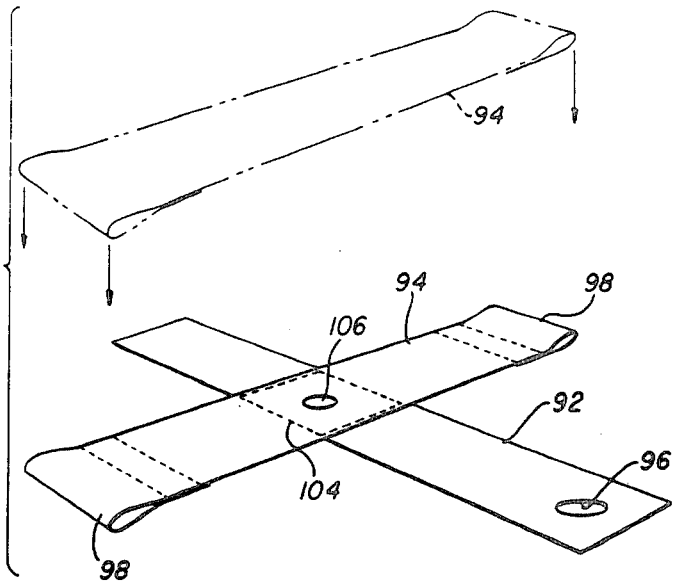

As shown in FIG. 10, panel 94 is laid over panel 92 and secured thereto with stitching 104. The area where panels 92 and 94 cross over comprises the bottom of receptacle 90. If desired, an opening 106 can be formed through panels 92 and 94 to receive a discharge spout assembly. A discharge spout assembly similar to spout assembly 62 in receptacle 10 can then be mounted in bottom opening 106.

Figure 11:
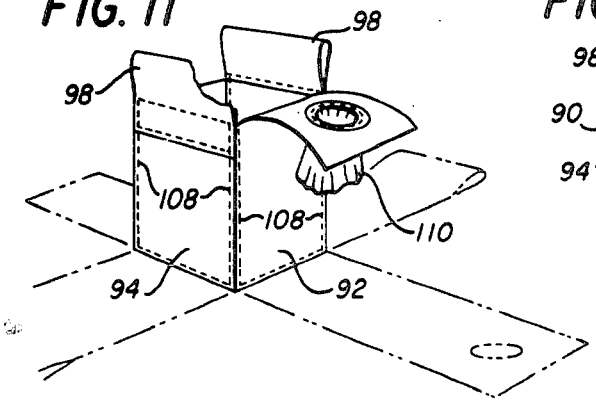

Panels 92 and 94 are folded inwardly and secured together along adjacent edges thereof by stitching 108, as is best shown in FIGS. 11 and 12. A fill spout 110 is then sewn into opening 96 in the upper portion of panel 92. This portion of panel 92 is then folded inwardly and secured about the periphery thereof by stitching 112 to the end panels 92 and 94. The top of receptacle 90 is thus closed in this manner. Any of the seam constructions illustrated in FIGS. 6*a*, 6*b*, 6*c* or 6*d* can be employed in constructing receptacle 90.

It will thus be apparent that collapsible receptacle 90 includes a bottom of double-layered construction. Receptacle 90 is comprised of two panels 92 and 94, each of which extends around the bottom of the receptacle for increased support. Lift sleeves 98 are connected by a continuous length of material uninterrupted by stitched seams.

Figure 16:
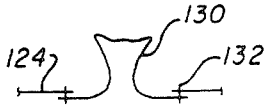

Referring now to FIGS. 13, through 16 there is shown a collapsible receptacle 120 incorporating a fourth embodiment of the invention. Various components of the fourth inventive embodiment are substantially identical in construction and function to components of the first embodiment, receptacle 10 shown in FIGS. 1–5. These identical components are designated in FIGS. 13 through 16 with same reference numerals as utilized hereinbefore in connection with receptacle 10, but are distinguished therefrom by means of a double prime (″) designation.

The primary distinction between receptacle 120 and receptacle 10 comprises bands 122 in panels 34″ and 36″, the latter of which is not shown in FIG. 13. Preferably, each panel 34″ and 36″ includes two longitudinal bands 122 extending the entire length thereof and positioned near each side edge thereof. Panels 34″ and 36″ are preferably formed of woven polypropylene or woven polyethylene material, while bands 122 are each formed of continuous strands woven straight into each panel. For example, each band 122 can be about one to two inches wide, and be comprised of about 50 strands of polyester. Bands 122 can also be woven into panels 34″ and 36″ in the form of selvage. It has been found that bands 122 in receptacle 120 further enhance the integral sling construction of the receptacle.

Referring to FIGS. 14–18, collapsible receptacle 120 preferably includes bottom panel 124 having discharge spout assembly 126 mounted therein. The bottom of receptacle 120 is constructed as follows. Panel 124 is provided with a central opening 128. A round or oblong configuration can be utilized for opening 128. In accordance with the preferred construction of the invention, opening 128 is generally oval or oblong in configuration. The longest dimension of opening 128 should be greater than the maximum bridging distance of the particular material 12 to avoid clogging of discharge spout assembly 126. It has been found that clogging or material bridging across an opening depends upon the width of the opening rather than area. An oval opening 128 is thus preferable because material bridging can be avoided with a relatively small opening which does not weaken panel 124 as much as a round or larger area opening.

As shown in FIG. 16, a spout 130 is then secured in opening 128 by stitching 132. It will be appreciated that panel 124 with spout 130 could be utilized as the top panel in receptacle 120..

Figure 17:
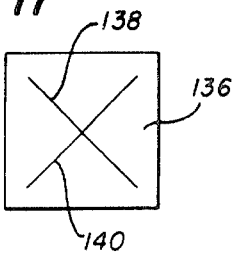
Figure 18:
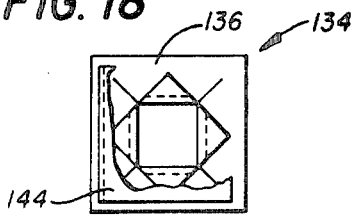

A closure subassembly 134, which is shown in FIGS. 17 and 18, is then secured over spout 130 to panel 124. Subassembly 134 includes another panel 136 which is relatively smaller than bottom panel 124. A pair of crosscuts 138 and 140 are formed through panel 136. Four flaps are thus formed by crosscuts 138 and 140. These flaps are next folded back and secured to panel 136, such as by means of sewing, to form guide loops for draw rope 142 shown in FIGS. 13 and 14. An optional cover flap 144 can then be sewn or otherwise secured to one side of panel 136 to complete construction of subassembly 134. The subassembly 134 is then attached to bottom panel 124 with stitching 146 to complete construction of discharge spout assembly 126.

It will be understood that the construction of panel 124 and discharge spout assembly 126 comprises a significant feature of the invention. This construction is not limited to receptacle 120, but can be employed in receptacle 10 or other receptacle constructions. The construction of this bottom panel begins with a panel/spout subassembly, which can be utilized by itself as a top panel. A bottom panel is formed simply by adding a closure subassembly 134 to panel 124. This facilitates the construction of both top and bottom panels. In addition, the use of subassembly 134 considerably reinforces panel 124 in the area surrounding spout 130 by eliminating high stress points at the corners of crosscuts 138 and 140.

FIGS. 19–22 illustrate the steps involved in constructing the collapsible receptacle 150 shown in FIG. 23. Receptacle 150 comprises a fifth embodiment of the invention herein. In contrast to the collapsible receptacles or receptacles shown in FIGS. 1–18, each of which is constructed from multiple pieces of suitable rectangular material, the receptacle 150 is constructed from a single piece of material. The method of constructing receptacle 150 can be adapted to automation and comprises a significant feature of this particular embodiment.

Figure 19:
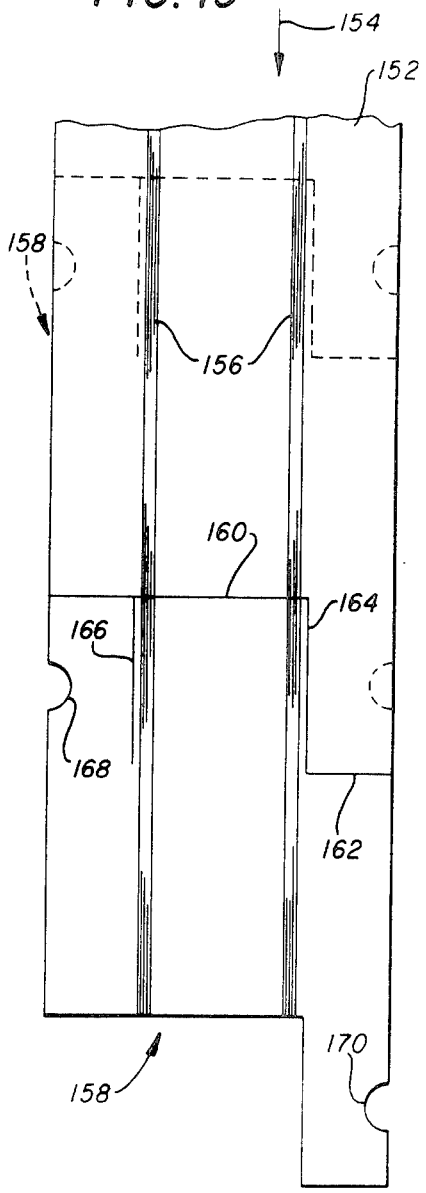

Referring to FIG. 19, a predetermined receptacle blank is first cut from a length of circular or tubular material 152. Suitable natural or synthetic material, such as woven polypropylene or woven polyethylene, can be used for material 152. Circular or tubular material 152 is in flattened condition and advanced from a supply thereof in the direction of arrow 154 into a cutting station. If desired, material 152 can include four integral reinforcing bands 156, only two of which are shown. Bands 156 are similar to bands 122 utilized in receptacle 120 described above. Each band 156, for example, comprises an area of one to two inch width with a plurality of continuous reinforcing strands extending in a longitudinal direction through material 152. Provision of bands 156 in material 152 enhances the integral sling construction of receptacle 150.

Receptacle blank 158 is cut from material 152 as follows. One transverse cut 160 extends inwardly from one edge of material 152 and across about $\frac{3}{4}$ of the width thereof. Another transverse cut 162 is made inwardly from the opposite edge of material 152 offset from cut 160 and across the remaining $\frac{1}{4}$ width of material 152. The ends of cuts 160 and 162 are connected by a longitudinal cut 164. Another longitudinal cut 166 intersects cut 160 at a point located at $\frac{1}{4}$ of the width of material 152 from the opposite edge thereof. Cuts 160, 162, 164 and 166 all extend through both layers of the flattened circular or tubular material 152.

It will be apparent that cut 166 remains in receptacle blank 158, while cuts 160–164 serve the purpose of severing the receptacle blank from material 152. Cuts 160, 162 and 164 define the upper end of the leading receptacle blank 158, and at the same time define the bottom end of the trailing receptacle blank. There is thus little or no material waste in forming each receptacle blank 158, which is one of the significant advantages of the fifth inventive embodiment herein.

In accordance with the preferred construction, two openings are then cut into the opposite longitudinal edges of receptacle blank 158. A generally semi-circular fill opening 168 is formed in the edge of receptacle blank 158 near cut 166. A generally semi-circular discharge opening 170 is preferably formed in the opposite edge of receptacle blank 158 at the bottom end thereof. Provision of opening 170 is optional and is not necessary if it is desired to construct receptacle 150 without a discharge spout.

Figure 20:
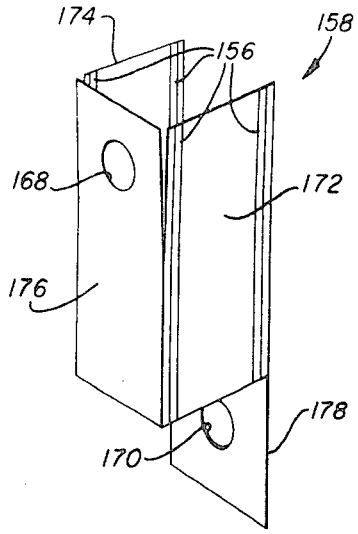

The tubular receptacle blank 158 is then opened as shown in FIG. 20. It will be observed that a pair of reinforcing bands 156 are provided in opposite panel portions 172 and 174 of the receptacle blank 158, while openings 168 and 170 are provided in the remaining pair of panel portions 176 and 178 thereof.

Figure 21:
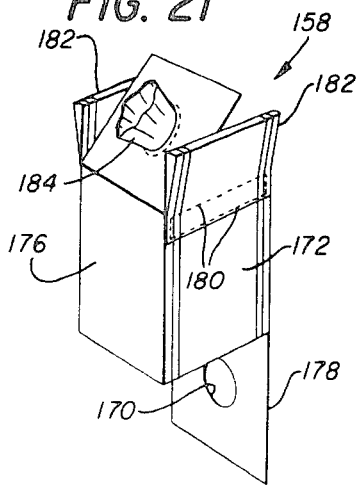

Referring to FIG. 21, the upper ends of panel portions 172 and 174 are then folded back and secured to themselves with at least one line of stitching 180 to form lift loops or sleeves 182. After formation of lift sleeves 182, a fill spout 184 is then sewn into opening 168 of panel portion 176 in receptacle blank 158. Installation of fill spout 184 is similar to that of spout 52 shown in FIG. 4.

Figure 22:
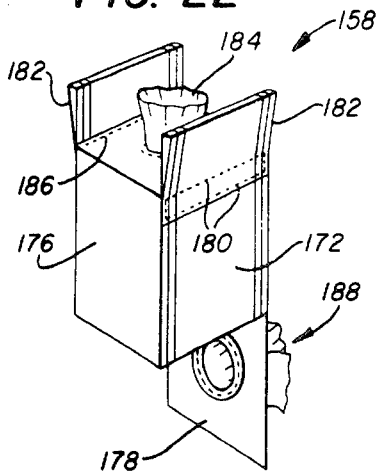

Referring to FIG. 22, the top end of panel portion 176 with fill spout 184 therein is folded inwardly and secured about the periphery thereof by stitching 186 to panel portions 172 and 174. Closure of the top end of receptacle 150 is thus completed with this step. A conventional wire tie (not shown) can be used to close fill spout 184.

Referring to FIGS. 22 and 23, a discharge spout assembly 188 is next sewn into opening 170 in the lower ends of panel portion 178. If desired, discharge spout assembly 188 can comprise simply a spout 190 and wire tie 192 installed in a fashion similar to fill spout 184. As shown in FIG. 23, the lower end of panel portion 178 is secured about the periphery of receptacle blank 158 by means of stitching 189.

FIGS. 24 and 25 illustrate the preferred construction of discharge spout assembly 188 in the open and extended position. A closure subassembly 134, which was previously described herein and shown in FIGS. 17 and 18, is secured to panel portion 178 around spout 190. The addition of closure subassembly 134 reinforces the bottom of receptacle 150.

FIG. 35 illustrates a collapsible receptacle 250 incorporating a sixth embodiment of the invention. The receptacle 250 is formed of a flexible, collapsible construction and is also useful in handling semi-bulk quantities of material.

Constructional details of the receptacle 250 are shown in FIGS. 26–34. The receptacle 250 includes a sheet 252 of a flexible, yet unexpandable, material. Natural or synthetic woven material can be employed. Jute, cotton, polyethylene or polypropylene are examples of such materials. It has been found the woven polypropylene and polyethylene materials are advantageous because of their strength, durability and puncture resistance.

In the preferred construction, the sheet 252 is formed in a rectangular shape having side edges 254 and 256, a top edge 258 and a bottom edge 260. The sheet 252 is folded along first fold lines 262 and 264 to define a first side panel 266 between the first folds and top and bottom edges 258 and 260.

Second folds 268 and 270 and third folds 272 and 274 are made in sheet 252 on either side of the first folds from the first side panel 266. The second and third folds define second and third side panels 276 and 278. Each side panel is formed of a panel half 280 and 281.

The side edges 254 and 256 are overlapped a distance X and secured together to form a fourth side panel 282. In the preferred construction, two glue lines are provided between the side edges. The glue line 284 is a hot melt glue for immediate adhesion between the side edges 254 and 256. The second glue line 286 is non-heated adhesive having a slower setting period than the glue in line 284 but having a greater final adhesion strength. The glue line 284 permits a rapid bond to be formed between the side edges 254 and 256 during construction of the receptacle 250 and maintains the position of the side edges permitting the glue on line 286 to properly set.

In a particular application, it may be desirable to increase the thickness of the side panels in the receptacle 250. This can of course be accomplished by increasing the thickness of the sheet 252. Alternatively, multiple sheets may be folded in a manner similar to sheet 252 to form multi-layered side panels in the receptacle 250. FIG. 27*a* illustrates a top view of the sheet 252 folded as herein described. FIG. 27*b* illustrates sheets 252 and 285 folded in an identical manner to form double layered side panels in the receptacle 250. The folds for the panels 252 and 285 are preferably offset so that the glue line between the side edges of each sheet is offset. Therefore, local stresses caused by material within the receptacle will never act directly on more than one glue line in the receptacle. FIG. 27*c* illustrates the use of sheets 252, 285 and 287 interfolded to form a triple layered side panel in the receptacle 250. Again, the glue lines between the side edges of each sheet is preferably offset. If desired, one or more sheets 252, 285 or 287 can be of a material impervious to the material stored in receptacle 250.

The next step in the formation of the receptacle 250 is the fastening together of adjacent panels at the first and third folds. In the preferred construction, this is accomplished by corner sew lines 288. The corner sew lines extend from the first and third folds upwardly and inwardly to the top edge 258 of the sheet 252. The corner sew lines 288 define flaps 290, 292, 294 and 296. The flaps are formed of a double thickness of the material of sheet 252.

The sheet 252 with sew lines 288 may still be retained in a flattened form for storage as illustrated in FIG. 28. When the sheet is expanded as shown in FIGS. 29 and 30, a top opening 298 is formed. When fully expanded, the sheet 252 forms a square opening 298 as illustrated in FIGS. 31 and 33.

The next step in construction is the formation of a bottom to receptacle 250. In one construction illustrated in FIG. 32, folds 300 are made on opposed side panels 276 and 278 extending from the bottom edge 260 near the center of the panel upward to intersect the first and third folds between the side panels. This forms square bottom panels 302 and 304 as shown in FIG. 32 formed from material from the adjacent side panels 266 and 282. The bottom panels may then be folded to form a flat bottom 306. The bottom 306 may be maintained by gluing the bottom panels to the folded material in the opposite side panels. Another suitable bottom is formed by securing the side panels together along the bottom edge 260 by stitching 307 as seen in FIG. 28. Stitching 307 secures panels 266, 282 and panel halves 280 and 281 in facing relation.

In another embodiment, a separate bottom panel 308 may close the lower end of the container 250. The panel 308 is substantially identical to panel 58 discussed hereinabove. The bottom panel 308 is secured about the periphery of the bottom edge 260 by stitching 310 at the bottom edges of side panels 266, 276, 278 and 282. A discharge spout assembly 312 may be positioned in the bottom panel 308. The spout assembly 312 is substantially identical to discharge spout assembly 62 described hereinabove, which in turn is substantially identical to the discharge spout assembly 70 illustrated and described in U.S. Pat. No. 4,143,796, the disclosure of which is herein incorporated by reference. Briefly, the spout assembly 312 includes a spout connected to an opening in the bottom panel 308. The spout may be closed with a wire tie. When not in use, the spout can be rolled up, covered with a flap 314 and closed inside flaps 320 by drawcord 322.

A fill spout 324 is mounted in the opening 298 as shown in FIG. 35. The spout 324 is generally cylindrical, and is secured by stitching 326 about the circumference of the opening 298. A wire tie 328 or other suitable device can be employed to close the fill spout 324.

To lift the receptacle 250, diagonal lifting straps 330 and 332 are provided. The ends of diagonal lifting strap 330 are secured to flaps 296 and 292, respectively. The strap is secured by stitching 334. However, glue may be used to attach the strap to the flaps, or, in combination stitching and glue.

The diagonal lifting strap 332 is similarly secured at its ends to flaps 290 (not shown in FIG. 36) and 294, respectively. Stitching 334 (not shown) is also employed to secure the strap to the flaps. Again, glue or combination glue and stitching may be used if desired.

It is apparent from FIG. 35 that the diagonal lifting straps 330 and 332 provide an effective way to lift the receptacle 250. The straps are secured to the flaps which have a double layered thickness of material for added strength. The diagonal attachment would permit the receptacle to be lifted by a single strap alone if desired. The flaps stand upright, urging the lifting straps upward for easy insertion of a forklift or other lifting device under the straps. A loop 350 is provided about the straps to insure that both straps are employed in lifting the receptacle.

Reinforcing bands 352 can be used as illustrated in FIG. 36. The bands 352 are secured along both the side panels at each of the first and third folds by gluing 354. In the receptacle illustrated in FIG. 36, the reinforcing bands 352 are formed integral with the diagonal lifting straps 330 and 332. The bands 352 are folded over the flaps and glued onto both sides of the flaps. However, separate reinforcing bands and straps can be used with the upper ends of the bands being secured to the lifting straps and flaps by stitching or other suitable fastening. In the preferred construction, the materials forming sheet 252 and reinforcing bands 352 are the same, or have similar elasticity. This will reduce the shear forces on the gluing 354 or other securing material when the receptacle is lifted.

From the foregoing, it will be understood that the present invention as embodied in receptacle 250 comprises an improved collapsible receptacle having numerous advantages over the prior art. The receptacle 250 is easily flattenable for storage and transport. The steps in manufacture may readily be automated with no complex or intricate stitching being necessary. The flaps formed by the stitching to form the top of the receptacle form an effective structure for lifting the receptacle. The glued side seams have been found to be much stronger than conventional sewed side seams in drop tests.

In one test, a sewed side seam flexible receptacle was found to withstand only about a 30" drop. The receptacle was a single wall sewn seam receptacle using four vertical panels of 6.5 square yards of fabric with a nominal fill strength of 275 pounds per inch. The receptacle held a 2200 pound load during the test. The work absorbed by the sewn sack is estimated to be 5500 foot pounds.

A receptacle incorporating a glued seam with the same nominal 275 pound per inch fabric and size has been found to take at least four drops of four feet with the same load. The work absorbed by the glued seam is 35,200 foot pounds, or more than six times that of the sewn seam. While the sewn and glued seam have about the same pull strength, the glued seam is much stronger during the drop test. This can be attributed to the far better distribution of impact load in the fabric by the glued seam.

FIGS. 37–41 illustrate an alternative method of attaching lifting loops to a collapsible receptacle of the types described hereinabove in connection with FIGS. 1–36. The use of the procedures shown in FIGS. 37–41 results in improved strength and greater resistance to damage to the receptacle resulting either from excessive loading or excessive mechanical shock.

Referring particularly to FIG. 37, a roll 360 comprises a length of flexible, yet unextensible, material 362. Jute, cotton, polyethylene or polypropylene are examples of such materials. It has been found that woven polypropylene and woven polyethylene materials are advantageous because of their strength, durability and puncture resistance.

The length of material 362 is initially folded to provide a double layer of material. Although any conventional technique may be used to fold the length of material 362, an inclined roller 364, a fixture 366 and a fixture 368 can advantageously be used for this purpose. Lift loops 370 are inserted between the two layers comprising the folded length of material 362 at predetermined intervals. The lift loops 370 preferably comprise U-shaped lengths of webbing of the type used in automobile seat belts and similar applications. Nylon, cotton, and similar materials may be used to weave the webbing which is used to form the lift loops 370.

An important feature of the present invention involves the fact that in positioning the lift loops 370 between the layers comprising the folded length of material 362, a gap or spacing is maintained between the two ends defining the U-shaped configuration of each lift loop 370 and the fold of the length of material 362. For example, in the practice of the invention it has been found advantageous to maintain a gap or spacing of approximately two (2) inches between the ends of the lift loops 370 and the fold of the length of material 362.

Following the insertion of the lift loops 370 and the completion of the fold, the folded length of material 362 having the lift loops 370 inserted between the layers thereof at predetermined intervals passes through a series of sewing machines 372. Although the use of three sewing machines 372 is illustrated in FIG. 37, it will be understood that the particular number of sewing machines used is not critical to the practice of the invention. Thus, in situations in which each sewing machine has only a single sewing needle it may be necessary to employ as many as 6 or 8 sewing machines. Conversely, if a sewing machine having up to 8 sewing needles is provided then the invention may be practiced utilizing a single sewing machine.

The sewing procedure serves to simultaneously secure the two layers comprising the length of material 362 one to the other, and also secures the lift loops 370 therebetween. The completed subassembly comprising the folded layers of the length of material 362 with the lift loops 370 secured therebetween is then wound onto a roll 374 with the loops 370 projecting from one end of the roll 374.

An alternative method of securing lift loops to a length of material is illustrated in FIG. 38. A roll 380 comprises a length of material 382 which preferably comprises a flexible, yet nonexpandable material. Natural or synthetic woven material may be employed. Jute, cotton, polyethylene or polypropylene are examples of such materials. It has been found that woven polypropylene or woven polyethylene materials are advantageous because of their strength, durability and puncture resistance.

The length of material 382 is approximately half as wide as the length of material 362 as shown in FIG. 37. The length of material 382 passes under a roller 384 and then through a mechanism 386 which applies adhesive to the surface of the length of material 382.

Lift loops 390 are then applied to the adhesive coated length of material 382. The lift loops 390 are preferably formed from webbing of the type utilized in automotive seat belts and similar applications. The webbing used to form the lift loops 390 may be formed from nylon, cotton, or similar materials.

The lift loops 390 are applied to the length of material 382 with the ends thereof defining the U-shaped configuration in a spaced apart relationship with respect to the adjacent edge of the length of material 382. That is, a gap or spacing is provided between the ends 390′ of each lift loop 390 and the adjacent edge 382′ of the length of material 382. In the practice of the invention a gap or spacing of approximately two (2) inches between the ends 390′ of the lift loops 390 and the edge 382′ of the length of material 382 has been found to be satisfactory.

Following positioning of the lift loops 390 thereon the length of material 382 passes between a pair of pinch rollers 392. The pinch rollers 392 function to securely engage the lift loops 390 with the adhesively coated surface of length of material 382. After passing between the pinch rollers 392 the length of material 382 with the lift loops 390 adhesively secured thereto is wound upon a roll 394.

Referring to FIG. 39, the construction of a collapsible receptacle by means of a length of material 400 having lift loops 402 secured thereto is shown. The subassembly comprising the length of material 400 having lift loops 402 secured thereto may be formed either by means of the technique illustrated in FIG. 37 or by means of the technique illustrated in FIG. 38.

A semifinished collapsible receptacle 404 is mounted on a platen 406. The receptacle 404 is preferably similar to the receptacle 250 illustrated in FIGS. 26–36. However, in accordance with the embodiment of FIG. 39 it is not necessary to provide folds in the semifinished receptacle 404.

A pinch roller 408 is used to secure the receptacle 404 in engagement with the platen 406. Upon rotation of the platen 406 in the direction indicated by the arrow 410, an adhesive applicator 412 is employed to deposit a layer of adhesive on the receptacle 404. As the leading edge of the layer of adhesive moves into the gap between the platen 406 and the pinch roller 408 the leading edge of the length of material 400 is simultaneously fed into the same gap. By this means the length of material 400 having the lift loops 402 secured thereto comes into engagement with the adhesive layer and is securely bonded to the receptacle 404 by means of the pressure exerted between the pinch roller 408 and the platen 406.

The application of adhesive by means of the applicator 412 and the simultaneous advance of the receptacle 404 by means of the platen 406 continues until the receptacle 404 has made a complete revolution. At that time a knife 414 is actuated to sever the length of material 400. Rotation of the platen 406 continues until the trailing edge of the length of material 400 has been adhesively secured to the receptacle 404. If desired, some overlap may be provided between the leading edge of the length of material 400 which is initially secured to the receptacle 404 and the trailing edge of the length of material 400 which is finally secured to the receptacle 404.

Figure 4:
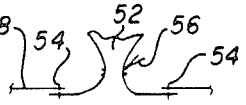
FIG. 4 is a diagrammatic sectional view taken along lines 4—4 of FIG. 3 in the direction of the arrows.

The receptacle 404 is completed by securing top and bottom panels thereto. The top panel may be formed as shown in FIGS. 2, 3 and 4 and as described hereinabove in connection therewith. The bottom panel may be formed as shown in FIGS. 24 and 25 and as described hereinabove in connection therewith. Alternatively, the bottom panel may be formed as shown in FIG. 34 and as described hereinbefore in connection therewith.

Referring now to FIGS. 40 and 41, collapsible receptacles 420 and 422 formed in accordance with the present invention are illustrated. Since the receptacles 420 and 422 are similar in many respects to those illustrated in FIGS. 1, 2, 13, 35 and 36, only the upper portions of the receptacles 420 and 422 are shown in FIGS. 40 and 41, respectively.

Receptacle 420 comprises a body 424 having a fabric strip 426 and lift loops 428 secured thereto. The receptacle 420 is formed by first securing the lift loops 428 to the fabric strip 426 in accordance with the procedure of FIG. 38, and then securing the fabric strip 426 having the lift loops 428 previously secured thereto to the body 424 in accordance with the procedure of FIG. 39. The receptacle 420 further includes a bottom panel which is not shown but which may be similar to the bottom panel illustrated in FIGS. 24 and 25 and described in conjunction therewith, and a top panel 430 which may be similar to the top panel shown in FIGS. 3 and 4 and described in conjunction therewith. The top panel is secured to the body 424, the fabric strip 426 and the lift loops 428 by means of stitching 432.

The receptacle 422 comprises a body 434 having a fabric strip 436 and lift loops 438 secured thereto. In the construction of the receptacle 422, the lift loops 438 are first secured to the fabric strip 436 in accordance with the procedure of FIG. 37. Thereafter the fabric layer 436 having the lift loops 438 secured thereto is adhesively secured to the body 434 in accordance with the procedure of FIG. 39. The receptacle 422 further includes a bottom panel which is not shown but which may be similar to the bottom panel shown in FIGS. 24 and 25 and described in conjunction therewith, and a top panel 440 which may be similar to the top panel shown in FIGS. 3 and 4 and described in conjunction therewith. The top panel 440 is secured to the body 434, the fabric strip 436 and the lift loops 438 by lines of stitching 442.

In addition to being adhesively bonded to the body 434, the fabric layer 436 is secured thereto by double lines of stitching 444. Such double lines of stitching 444 may also be used to further secure the strip 426 to the body 424 of the receptacle 420, if desired.

As is clearly shown in FIG. 40, the ends 428' of the lift loops 428 are separated by a distance X from the lower edge 426' of the fabric layer 426. Similarly, the lower ends 438' of the lift loops 438 are separated by a distance X from the lower edge 436' of the fabric layer 436 of the receptacle 422. Such separation between the lower ends of the lift loops and the lower edge of the fabric layer comprises an important feature of the present invention. By this means any stress concentration that might otherwise occur when the lift loops are used to lift the receptacle is eliminated. Instead, the lifting force is transmitted from the lift loops into the adhesive layer which secures the lift loops and the overlying fabric strip to the body of the container and hence into the receptacle body with no undue stress concentrations occurring. This prevents both possible separation of the lift loops from the receptacle and possible tearing of the receptacle at the point of attachment of the lift loops thereto.

Referring now to FIG. 42, yet another embodiment of the invention is shown. A length of fabric material 450 is received from a roll 452 and travels in the direction of an arrow 454. A length of fabric material 450 may comprise various natural and synthetic materials fabricated utilizing various conventional techniques. Preferably, the length of fabric material 450 comprises woven fabric material formed from either polypropylene or polyethylene or both.

The length of fabric material 450 travels from the roll 452 around a roller 456 and then through a folding assembly 458 which folds one edge of the length of fabric material inwardly. An adhesive application mechanism 460 deposits adhesive between the two layers of the folded edge of the length of fabric material 450 prior to engagement therebetween. The folded edge of the length of fabric material 450 then passes between the pair of pinch rollers 462 which function to force the two layers comprising the folded edge into intimate contact with the adhesive, thereby assuring a strong bond.

The length of fabric material 450 next passes through an adhesive application mechanism 464. The adhesive application mechanism 464 has an adhesive depositing head 466 which travels in the direction indicated by the arrow 468 at the same time the length of fabric material 450 is traveling in the direction indicated by the arrow 454. By this means the adhesive application mechanism 464 is caused to deposit V-shaped patterns of adhesive at spaced intervals along the length of fabric material 450.

A length of webbing material 470 is supplied from a roll 472. Various natural and synthetic materials may be utilized in forming the length of webbing material 470. However, in the preferred embodiment of the invention the length of webbing material 470 is fabricated from polyester or nylon.

The length of webbing material 470 is positioned on the length of fabric material 450 so as to overlie each V-shaped pattern of adhesive as deposited by the adhesive application mechanism 464. As is clearly shown in FIG. 42, this causes the length of webbing material 470 to be secured to the length of fabric material 450 in a series of loops 474. In each loop 474 the length of webbing material 470 is twisted one half turn. At each point of attachment to the length of fabric material 450 the length of webbing material 470 is folded back upon itself to define a series of V-shaped folds 476 each positioned a predetermined distance from the adjacent edge 478 of the length of fabric material 450.

The length of fabric material 450 with the loops 474 comprising the length of webbing material 470 positioned thereon next passes between a pair of pinch rollers 480. Rollers 480 force the length of fabric material 450 and the length of webbing material 470 into intimate contact with the adhesive therebetween, thereby assuring a strong adhesive bond between the length of webbing material 470 and the length of fabric material 450.

The length of fabric material 450 with the loops 474 secured thereto next passes through a sewing machine 482. The sewing machine 482 has a sewing head 484 which moves in the direction indicated by the arrow 486 as the length of fabric material moves in the direction indicated by the arrow 454. The movement of the sewing head 484 is coordinated so that lines of stitching 488 are formed first along the folded edge of the length of fabric material 450, and then along the length of webbing material 470 at its point of attachment to the length of fabric material 450, and then along the folded edge of the length of fabric material, etc. The sewing head may also be supported for rotational or pivotal movement about a vertical axis so as to maintain a predetermined spacing between the lines of stitching 488, or two or more separate sewing machines may be employed to form the lines of stitching 488.

It will thus be understood that the loops 474 and the folds 476 comprising the length of webbing material 470 are secured to the length of fabric material both adhesively and by sewing. Upon completion of the sewing step the length of fabric material is wound onto a reel 490. As the length of fabric material 450 is wound onto the reel 490 the loops 474 project outwardly from one end thereof.

FIG. 43 illustrates the result of the steps illustrated in FIG. 42. The length of fabric material 450 has a folded upper edge, with the layers comprising the fold being adhesively secured in place. The length of webbing material 470 is formed into a series of prefabricated lift loops 474. The lift loops 474 are equal in size and equally spaced along the length of fabric material 450. The lift loops 474 are secured to the length of fabric material 450 both adhesively and by means of sewing. The lines of stitching 488 are formed first along the folded upper edge of the length of fabric material 450, and then along the length of webbing material 470 at its points of attachment to the length of fabric material 450 to form the lift loops 474. The length of webbing material 470 is twisted one half turn within each loop 474. Adjacent lift loops 474 are interconnected by folds 476 each positioned a predetermined distance from the adjacent edge 478 of the length of fabric material 450. The zones of attachment between the length of fabric material 450 and the length of webbing material 470 are of a V-shaped configuration with a predetermined angle therebetween and with the fold 476 comprising the vertex of each angle. In actual practice, the relationship between the attached portion of one lift loop 474 and the adjacent attached portion of the next lift loop 474 is preferably about 90°. That is, the angle between each attached lift loop portion and a line extending normal to the longitudinal axis of the length of fabric material 450 is about 45°.

The construction shown in FIG. 43 is utilized to manufacture a receptacle in exactly the same manner shown in FIGS. 39, 40 and 41 and described hereinabove in connection therewith. That is, the length of fabric material 450 having the lift loops 474 secured thereto is in turn secured around the upper end of a tubular receptacle construction. The length of fabric material 450 may be secured to the upper end of the tubular receptacle construction by means of an adhesive, or by means of sewing, or by means of a combination of the two techniques.

FIG. 46 illustrates a bottom construction 491 which may be utilized in the practice of the invention. A discharge chute 492 is formed from a rectangular length of fabric material. The length of fabric material is rolled into a tube, and the overlapping edges are secured in place, either by means of an adhesive or by means of sewing. The upper end of the tubular construction is then folded outwardly to form a flange 494. An upper sheet 496 for the bottom construction 491 is formed from fabric. A circular aperture 498 is formed in the center of the upper sheet 496. The discharge chute is extended through the aperture 498 in the sheet 496 until the flange 494 engages the upper surface of the sheet 496. The discharge chute is then secured in place either by means of an adhesive or by sewing.

A lower sheet 500 for the bottom construction 491 is also formed from fabric. The lower sheet 500 has a rectangular aperture 502 formed in the center thereof. A length of fabric 504 is secured to the lower sheet 500 by sewing and normally overlies the aperture 502 to form a protective closure.

A pair of semicircular lift fork receiving members 506 are positioned between the upper sheet 496 and the lower sheet 500 by the receptacle bottom construction. The lift fork receiving members 506 are preferably formed from cardboard, but may also be formed from other suitable materials, such as plastic.

The bottom construction 491 is completed by sewing the sheets 496 and 500 one to the other. Lines of stitching are extended along each edge of each lift fork receiving member 506 so that the members 506 are secured in place.

Referring now to FIG. 47, there is shown a collapsible receptacle 510 constructed in accordance with the embodiments of the invention illustrated in FIGS. 42, 43 and 46. The receptacle 510 has a side wall 512 formed from fabric material, preferably woven polypropylene or woven polyethylene material. The side wall 512 comprises a rectangular piece of fabric material which is rolled into a tubular configuration. The overlapping edges of the side wall 512 are then secured to each other, either by means of an adhesive or by means of sewing, or by a combination of both techniques.

The length of fabric material 450 shown in FIG. 43 is secured to the upper end of the sidewall 512 of the receptacle 510. The length of fabric material 450 is secured to the sidewall 512 either by means of an adhesive layer, or by means of sewing, or by means of a combination of the two techniques. The length of fabric material 450 is secured to the sidewall 512 with the lift loops 474 projecting above the upper end of the sidewall. The lift loops 474 are thus positioned to receive the lift forks 514 of a lift truck 516. With the lift forks 514 thus received in the lift loops 474 the lift truck 516 may be utilized to raise and lower the receptacle 510; to position the receptacle 510 for filling, for storage, or for discharge; etc.

The receptacle 510 further includes a top wall 518 secured to the upper end of the side wall 512 and serving to close the upper end of the receptacle. The top wall 518 may be fabricated in accordance with other aspects above the invention, for example, the top wall 518 may be fabricated as shown in FIG. 4. The top wall 518 may be secured to the upper end of the side wall 512 by means of a line of stitching 520 also serving to secure or to partially secure the length of fabric material 450 to the side wall 512.

The receptacle 510 also includes a bottom wall 522. The bottom wall 522 shown in FIG. 47 is of the type incorporating the embodiment of the invention illustrated in FIG. 46. Thus, the bottom wall 522 includes lift fork receiving members 506 adapted to receive the lift forks of a fork lift truck, whereby the receptacle 510 may be manipulated from the bottom, rather than from the top.

The receptacle 510 is normally positioned utilizing lift forks, such as the lift forks 514, received through the lift loops 474. However, in certain instances there may be insufficient room above the desired positioning of the receptacle to permit use of the lift loops 474 for manipulation of the receptacle. In such instances the members 506 may be utilized to receive lift forks such as the lift forks 514 of the lift truck 516.

Those skilled in the art will appreciate the fact that the receptacle 510 may be constructed utilizing the length of fabric material 450 and the loops 474 secured thereto without utilizing a bottom wall 522 of the type shown in FIG. 46. For example, the receptacle 510 may be fabricated utilizing a bottom wall of the type shown in FIG. 24. Conversely, the receptacle 510 may utilize the bottom wall construction shown in FIG. 46 without utilizing the length of fabric material 450. For example, the various types of lift fork receiving loops shown in FIGS. 1, 35, 37 and 38 may be utilized in the receptacle 510 in lieu of the loops 474, or the receptacle 510 may be fabricated without any lift loops whatsoever.

Referring now to FIG. 44, there is shown a modification of the embodiment of the invention illustrated in FIGS. 42 and 43. In accordance with the modification of FIG. 44, various components are utilized which are substantially identical in construction and function to components utilized in the embodiment of FIGS. 42 and 43. Such identical components are indicated in FIG. 44 with the same reference numerals utilized in conjunction with FIGS. 42 and 43, but are differentiated therefrom by means of a prime (') designation.

A length of fabric material 450' has a folded upper edge which is adhesively secured in place. The length of webbing material 470' is secured to the length of fabric material 450' in the manner illustrated in FIG. 42, that is, preliminarily by means of an adhesive layer positioned between the length of fabric material 450' and the length of webbing material 470', and thereafter by means of sewing which results in lines of stitching 488'.

The length of webbing material 470' is secured to the length of fabric material 450' in the form of a series of lift loops 474'. The lift loops 474' are identical in size and are positioned at spaced intervals along the length of fabric material 450'. The length of webbing material 470' is twisted one half turn within each loop 474'.

The length of webbing material 470' further includes a plurality of folds 476'. The sole distinction between the embodiment of the invention shown in FIG. 43 and the modification thereof shown in FIG. 44 is that in accordance with the modification of FIG. 44, the folds 476' of the length of webbing material 470' are positioned beneath the lower edge 478' of the length of fabric material 450'. This produces a small open loop 524 situated between each fold 476' and the adjacent lower edge 478' of the length of fabric material 450'.

Referring now to FIG. 45, there is shown a receptacle 526 incorporating the modification of FIG. 44. Many of the component parts of the receptacle 526 are substantially identical in construction and function to component parts of the receptacle 510 shown in FIG. 47 and discussed hereinabove in connection therewith. Such identical component parts are indicated in FIG. 45 by means of the same reference numerals utilized in FIG. 47, but are differentiated therefrom by means of a prime (') designation.

The receptacle 526 has a bottom wall 548 formed in accordance with the teaching of FIG. 25. Such a bottom wall has a discharge spout 550 which is closed by means of a drawstring 552.

The receptacle 526 utilizes a sling 554. The sling includes a lower ring or loop 556 surrounding the discharge spout 550 of the bottom wall 548. The sling further includes four straps 560 each having loops 562 and 564 at the opposite ends thereof. Each loop 562 surrounds the lower ring 556, and each loop 564 extends through one of the loops 524 formed by the length of webbing material 470' secured to the length of fabric material 450'. It will thus be understood that the lift loops 474' operate through the sling 554 to support the contents of the receptacle 526. The sling 554 is actually considered redundant because, as is true in the case of the receptacle 510 shown in FIG. 47, the fabric comprising the receptacle 526 is fully capable of supporting the contents thereof. However, in certain applications of the invention the use of an external sling is considered desirable, and in such instances the embodiment of FIG. 45 may be used.

Referring now to FIGS. 48, there is shown an assembly 600 comprising a length of fabric material 602 having a length of webbing material 604 secured thereto to define a plurality of prefabricated lift loops 606. It will be appreciated that the assembly 600 is similar in many respects to the construction illustrated in FIG. 43. Preferably, the assembly 600 is fabricated similarly to the construction of FIG. 43 by means of the method and apparatus illustrated in FIG. 42 and described hereinabove in conjunction therewith.

The assembly 600 differs from the construction of FIG. 43 in two significant aspects. First, the material utilized to form the length of webbing material 604 is preferably identical to the material utilized to construct the length of fabric material 602. That is, if the length of fabric material 602 is constructed from polypropylene, the length of fabric material 604 is likewise constructed from polypropylene, etc. The purpose in matching the material of the length of webbing material 604 to that of the length of fabric material 602 is to assure that the stretching of the length of fabric material 602 will correspond to that of the length of webbing material 604 when the assembly 600 is subjected to loading. It has been found that if the length of fabric material 602 is formed from a different material from that used in the manufacture of the length of webbing material 604 the stretching of the length of fabric material may be different from that of the length of webbing material when the assembly 600 is subjected to loading. In such instances the stitching which is utilized to connect the length of webbing material 604 to the length of the fabric material 602 may be subjected to undue stress.

Another differentiation between the assembly 600 shown in FIG. 48 and the construction shown in FIG. 43 relates to the dimension X comprising the distance between the lowermost edges of the lift loops 606 and an imaginary stitching receiving line 608. It is important that the dimension X be sufficient that when a collapsible receptacle comprising the assembly 600 is lifted by means of the lift loops 606, the stress imposed on the assembly 600 through the connection of the length of webbing material 604 to the length of fabric material 602 is dissipated into the length of fabric material 602 and is not imposed directly on stitches extending along the imaginary line 608. Otherwise, stitches extending along the imaginary stitching receiving line 608 can be pulled loose, leading to failure of the entire collapsible receptacle. In actual practice it has been found that a dimension X of approximately 1 inch is sufficient to assure that loads imposed on the assembly 600 by lifting a collapsible receptacle comprising the assembly by means of the lift loops 606 are dissipated into the length of fabric material 602 and are not imposed directly on stitches extending along the imaginary stitching receiving line 608.

Referring to FIG. 49, there is shown a collapsible receptacle 610 incorporating the assembly 600 of FIG. 48. The collapsible receptacle 610 includes a body 612 formed from fabric material. The assembly 600 is secured to the body 612 by means of a plurality of lines of stitching 614, 616, 618 and 620. In the practice of the invention an adhesive layer may be used in lieu of the lines of stitching 614, 616 and 618, if desired. For example, the assembly 600 may be secured to the body 612 as shown in FIG. 39 and described hereinabove in conjunction therewith.

The lowermost line of stitching 620 extends along the imaginary stitching receiving line 608 of FIG. 48. Thus, the predetermined dimension X of FIG. 48 is maintained in the collapsible receptacle 610 by positioning the lowermost stitching line 620 sufficiently below the lowermost edges of the length of webbing material 604. As mentioned above, it has been found that a separation between stitching line 620 and the lowermost ends of the lift loops 606 of at least 1 inch is sufficient to assure that loads imposed on the components of the receptacle 610 by lifting the receptacle by means of the lift loops 606 are dissipated into the length of fabric material 602 and are not imposed directly on the stitches comprising the lowermost line of stitching 620.

The use of the embodiments of the invention shown in FIGS. 42, 43, 44, 45, 47, 48 and 49 is highly advantageous because, in accordance with certain applications of the invention, an individual lift loop of a receptacle must be capable of supporting the entire contents thereof while the remaining lift loops are entirely unsupported. As will be appreciated by reference to FIGS. 42–45 and 47–49, the lift loops therein disclosed are secured to the underlying length of fabric material at a substantial angle with respect a line extending normal to the longitudinal axis of the length of fabric material. By this means the weight of the contents of the receptacle is transferred to the lift loops in a direction tending to prevent stress concentrations which in turn prevents the lift loops from separating from the underlying structure of the receptacle.

Although preferred embodiments of the invention have been illustrated in the accompanying Drawings and described in the foregoing Detailed Description, it will be understood that the invention is not limited to the embodiments disclosed, but is capable of numerous rearrangements, modifications, and rearrangements of parts and elements without departing from the spirit of the invention.

We claim:

1. A method of making collapsible receptacles comprising:

providing a length of fabric material having a longitudinal axis and having upper and lower edges;

providing a length of webbing material;

securing the length of webbing material to the length of fabric material in the form of a plurality of substantially equal sized, substantially equally spaced lift loops having lowermost ends;

the securing step being further characterized by positioning each lift loop comprising the length of webbing material with the central portion thereof extending above the upper edge of the length of fabric material, securing the opposite end portions of each lift loop to the length of fabric material with each secured end portion of each lift loop extending at a predetermined angle with respect to a line extending normal to the longitudinal axis of the length of fabric material, and positioning the lowermost ends of the lift loops more than a predetermined distance above the lower edge of the length of fabric material, said predetermined distance including the sum of the distance between an imaginary stitching receiving line and the lower edge of the length of fabric material and the distance between the lowermost edges of the lift loops and the imaginary stitching receiving line, wherein said stitching receiving line comprises a location for connection of said length of fabric material to the remainder of said collapsible receptacle and the distance between the lowermost edges of the lift loops and the imaginary stitching receiving line is such that tensile stress imposed on said lift loops is dissipated into said length of fabric material between said lift loops and said imaginary stitching receiving line.

2. The method of making collapsible receptacles according to claim 1 including the additional step of twisting the length of webbing material one half turn within the unattached central portion of each lift loop prior to securing the opposite ends of the lift loop to the length of fabric material.

3. The method of making collapsible receptacles according to claim 2 including the additional step of folding the length of webbing material at the point of intersection of the attached end portions of adjacent lift loops.

4. The method of making collapsible receptacles according to claim 1 further characterized by at least partially securing each lift loop to the length of fabric material by means of an adhesive bond therebetween.

5. The method of making collapsible receptacles according to claim 1 further characterized by at least partially securing each lift loop to the length of fabric material by means of stitching.

6. The method of making collapsible receptacles according to claim 1 further characterized by securing the end portions of each lift loop to the length of fabric material both by means of an adhesive bond therebetween and by means of stitching.

7. The method of forming collapsible receptacles according to claim 1 further characterized by:

forming a rectangular piece of fabric material into a tubular receptacle side wall;

securing the length of fabric material having the length of webbing material previously secured thereto to the upper end of the tubular receptacle side wall with the unattached central portions of the lift loops projecting above the upper end of the tubular receptacle side wall; and said securing step being further characterized by forming at least one line of stitches to at least partially secure the length of fabric material to the upper end of the tubular receptacle, and positioning the line of stitches a predetermined distance below the lowermost ends of the lift loops.

8. The method of making collapsible receptacles according to claim 1 further characterized by providing a length of fabric material and providing a length of webbing material which are formed from the same material.

9. A method of forming collapsible receptacles comprising:

forming a rectangular piece of fabric into a tubular receptacle side wall;

securing a fabric top wall to the upper end of the tubular receptacle side wall to close the upper end of the receptacle;

securing a fabric bottom wall to the lower end of the tubular receptacle side wall to close the lower end of the receptacle;

providing a length of fabric material having a length at least as long as the circumference of the tubular receptacle side wall;

providing a length of webbing material;

securing the length of webbing material to the length of fabric material in the form of a plurality of substantially equally sized, substantially equally spaced lift loops having lowermost ends;

said step of securing the length of webbing material to the length of fabric material being characterized by securing the opposite ends of each loop through the length of fabric material at a predetermined angle with respect to a line extending normal to the longitudinal axis of the length of fabric material and with the central portion of each lift loop unattached and extending above the upper edge of the length of fabric material and with the lowermost ends of the lift loops positioned more than a predetermined distance above the lower edge of the length of fabric material;

subsequently securing the length of fabric material having the length of webbing material previously secured thereto to the upper portion of the tubular receptacle side wall with the unattached central portions of the lift loops extending above the upper edge of the tubular receptacle side wall; and the step of securing the length of fabric material to the tubular receptacle side wall being further characterized by forming a line of stitching to at least partially secure the length of fabric material to the tubular receptacle side wall, said line of stitching being positioned at least said predetermined distance below the lowermost ends of the lift loops, said predetermined distance including the sum of the distance between an imaginary stitching receiving line and the lower edge of the length of fabric material and the distance between the lowermost edges of the lift loops and the imaginary stitching receiving line, wherein said stitching receiving line comprises a location for connection of said length of fabric material to the remainder of said collapsible receptacle and the distance between the lowermost edges of the lift loops and the imaginary stitching receiving line is such that tensile stress imposed on said lift loops is dissipated into said length of fabric material between said lift loops and said imaginary stitching receiving line.

10. The method of making collapsible receptacles according to claim 9 wherein the length of webbing material is twisted one half turn within the unattached central portion of each lift loop.

11. The method of making collapsible receptacles according to claim 9 wherein the length of webbing material is folded at the point of intersection of the attached end portions of adjacent lift loops.

12. The method of making collapsible receptacles according to claim 9 further characterized by providing lengths of fabric material and webbing material which are formed from the same material.

13. A collapsible receptacle comprising:

a tubular receptacle side wall formed from fabric and having a predetermined circumference;

a length of fabric material having a length at least as long as the circumference of the tubular receptacle side wall and secured to the upper portion of the tubular receptacle side wall;

a length of webbing material secured to the length of fabric material in the form of a series of substantially equally sized, substantially equally spaced lift loops having lowermost ends;

each of the lift loops comprising the length of webbing material including attached portions at the opposite ends thereof and an unattached central portion extending above the upper end of the tubular receptacle side wall;

each end portion of each lift loop comprising the length of webbing material being secured to the length of fabric material at a predetermined angle with respect to a line extending normal to the longitudinal axis of the length of fabric material; and at least one line of stitching forming at least a partial connection between the tubular receptacle side wall and the length of fabric material, said line of stitching being positioned at least a predetermined distance below the lowermost ends of the lift loops.

14. The collapsible receptacle according to claim 13 further characterized by:

adhesive positioned between and mechanically connecting each attached end portion of each lift loop and the length of fabric material for partially securing the length of webbing material to the length of fabric material; and at least one line of stitching mechanically connecting each attached end portion of each lift loop and the length of fabric material for partially securing the length of webbing material to the length of fabric material.

15. The collapsible receptacle according to claim 13 wherein the unattached central portion of each lift loop is twisted one half turn.

16. The collapsible receptacle according to claim 13 wherein the length of webbing material is folded at the point of intersection of adjacent attached end portions of adjacent lift loops comprising the length of webbing material.

17. The collapsible receptacle according to claim 13 further including:

a fabric top wall secured to the upper end of the tubular receptacle side wall for closing the upper end of the receptacle; and a fabric bottom wall secured to the lower end of the tubular receptacle side wall for closing the lower end of the receptacle.

18. The collapsible receptacle of claim 13 wherein said length of fabric material is formed by multiple layers of fabric material, a line of adhesive fastening each of said multiple layers of material individually along a line spaced from the adhesive line of the others of said multiple layers of material to increase the strength of the collapsible receptacle.

19. The collapsible receptacle of claim 18 wherein said adhesive line includes one line of a relatively quick setting weaker adhesive and at least one line of relatively stronger slower setting adhesive.

20. The collapsible receptacle according to claim 13 wherein the length of fabric material and the length of webbing material are formed from the same material.

21. A method of making collapsible receptacles comprising:

providing a length of fabric material having a longitudinal axis and formed from a predetermined material;

providing a length of webbing material formed from the same predetermined material as the length of fabric material;

securing the length of webbing material to the length of fabric material in the form of a plurality of substantially equal sized, substantially equally spaced lift loops;

the securing step being further characterized by positioning each lift loop comprising the length of webbing material with the central portion thereof extending above the upper edge of the length of fabric material and securing the opposite end portions of each lift loop to the length of fabric material with each secured end portion of each lift loop extending at a predetermined angle with respect to a line extending normal to the longitudinal axis of the length of fabric material.

22. The method of making collapsible receptacles according to claim 21 including the additional step of twisting the length of webbing material one half turn within the unattached central portion of each lift loop prior to securing the opposite ends of the lift loop to the length of fabric material.

23. The method of making collapsible receptacles according to claim 22 including the additional step of folding the length of webbing material at the point of intersection of the attached end portions of adjacent lift loops.

24. The method of making collapsible receptacles according to claim 21 further characterized by at least partially securing each lift loop to the length of fabric material by means of an adhesive bond therebetween.

25. The method of making collapsible receptacles according to claim 21 further characterized by at least partially securing each lift loop to the length of fabric material by means of stitching.

26. The method of making collapsible receptacles according to claim 21 further characterized by securing the end portions of each lift loop to the length of fabric material both by means of an adhesive bond therebetween and by means of stitching.

27. The method of forming collapsible receptacles according to claim 21 further characterized by:

forming a rectangular piece of fabric material into a tubular receptacle side wall; and securing the length of fabric material having the length of webbing material previously secured thereto to the upper end of the tubular receptacle side wall with the unattached central portions of the lift loops projecting above the upper end of the tubular receptacle side wall.

28. The method of forming collapsible receptacles according to claim 27 further characterized by:

forming at least one line of stitches to a least partially secure the length of fabric material to the upper end of the tubular receptacle; and positioning the line of stitches a predetermined distance below the lowermost ends of the lift loops.

29. A method of forming collapsible receptacles comprising:

forming a rectangular piece of fabric into a tubular receptacle side wall;

securing a fabric top wall to the upper end of the tubular receptacle side wall to close the upper end of the receptacle;

securing a fabric bottom wall to the lower end of the tubular receptacle side wall to close the lower end of the receptacle;

providing a length of fabric material having a length at least as long as the circumference of the tubular receptacle side wall and formed from a predetermined material;

providing a length of webbing material formed from the same predetermined material as the length of fabric material;

securing the length of webbing material to the length of fabric material in the form of a plurality of substantially equally sized, substantially equally spaced lift loops;

said step of securing the length of webbing material to the fabric material being characterized by securing the opposite ends of each loop through the length of fabric material at a predetermined angle with respect to a line extending normal to the longitudinal axis of the length of fabric material and with the central portion of each lift loop unattached and extending above the upper edge of the length of fabric material; and subsequently securing the length of fabric material having the length of webbing material previously secured thereto to the upper portion of the tubular receptacle side wall with the unattached central portions of the lift loops extending above the upper edge of the tubular receptable side wall.

30. The method of making collapsible receptacles according to claim 29 wherein the length of webbing material is twisted one half turn within the unattached central portion of each lift loop.

31. The method of making collapsible receptacles according to claim 29 wherein the length of webbing material is folded at the point of intersection of the attached end portions of adjacent lift loops.

32. The method of making collapsible receptacles according to claim 29 wherein the step of securing the length of fabric material to the upper end of the tubular receptacle side wall is further characterized by forming a line of stitching therebetween with the line of stitching located a predetermined distance below the lowermost ends of the lift loops.

33. A collapsible receptacle comprising:

a tubular receptacle side wall formed from fabric and having a predetermined circumference;

a length of fabric material having a length at least as long as the circumference of the tubular receptacle side wall and secured to the upper portion of the tubular receptacle side wall;

a length of webbing material secured to the length of fabric material in the form of a series of substantially equally sized, substantially equally spaced lift loops;

the length of fabric material and the length of webbing material being formed from the same predetermined material;

each of the lift loops comprising the length of webbing material including attached portions at the opposite ends thereof and an unattached central portion extending above the upper end of the tubular receptacle side wall;

each end portion of each lift loop comprising the length of webbing material being secured to the length of fabric material at a predetermined angle with respect to a line extending normal to the longitudinal axis of the length of fabric material.

34. The collapsible receptacle according to claim 33 further characterized by:

adhesive positioned between and mechanically connecting each attached end portion of each lift loop and the length of fabric material for partially securing the length of webbing material to the length of fabric material; and at least one line of stitching mechanically connecting each attached end portion of each lift loop and the length of fabric material for partially securing the length of webbing material to the length of fabric material.

35. The collapsible receptacle according to claim 33 wherein the unattached central portion of each lift loop is twisted one half turn.

36. The collapsible receptacle according to claim 33 wherein the length of webbing material is folded at the point of intersection of adjacent attached end portions of adjacent lift loops comprising the length of webbing material.

37. The collapsible receptacle according to claim 33 further including:

a fabric top wall secured to the upper end of the tubular receptacle side wall for closing the upper end of the receptacle; and a fabric bottom wall secured to the lower end of the tubular receptacle side wall for closing the lower end of the receptacle.

38. The collapsible receptacle of claim 33 wherein said length of fabric material is formed by multiple layers of fabric material, the line of adhesive fastening each of said multiple layers of material extending along a line spaced from the adhesive line of the other multiple layers of material to increase the strength of the collapsible receptacle.

39. The collapsible receptacle of claim 38 wherein each said adhesive line includes one line of a relatively quick setting weaker adhesive and at least one line of relatively stronger slower setting adhesive.

40. The collapsible receptacle according to claim 33 wherein the length of fabric material is at least partially secured to the tubular receptacle side wall by means of a line of stitching located at least a predetermined distance below the lowermost ends of the lift loop.

41. A method of making collapsible receptacles comprising:

providing a length of fabric material having a longitudinal axis;

providing a length of webbing material;

securing the length of webbing material to the length of fabric material in the form of a plurality of substantially equal sized, substantially equally spaced lift loops; and the securing step herein further characterized by positioning each lift loop comprising the length of webbing material with the central portion thereof extending above the upper edge of the length of fabric material and securing the opposite end portions of each lift loop to the length of fabric material with each secured end portion of each lift loop extending at a predetermined angle with respect to a line extending normal to the longitudinal axis of the length of fabric material.

42. The method of making collapsible receptacles according to claim 41 including the additional step of twisting the length of webbing material one half turn within the unattached central portion of each lift loop prior to securing the opposite ends of the lift loop to the length of fabric material.

43. The method of making collapsible receptacles according to claim 41 further characterized by at least partially securing each lift loop to the length of fabric material by means of an adhesive bond therebetween.

44. The method of making collapsible receptacles according to claim 41 further characterized by at least partially securing each lift loop to the length of fabric material by means of stitching.

45. The method of forming collapsible receptacles according to claim 41 further characterized by:

forming a rectangular piece of fabric material into a tubular receptacle side wall; and securing the length of fabric material having the length of webbing material previously secured thereto to the upper end of the tubular receptacle side wall with the unattached central portions of the lift loops projecting above the upper end of the tubular receptacle side wall.

46. The method of forming collapsible receptacles according to claim 45 including the additional step of securing a top wall to the upper end of the tubular receptacle side wall and thereby closing the upper end of the receptacle.

47. The method of forming collapsible receptacles according to claim 46 including the additional step of securing a bottom wall to the lower end of the tubular receptacle side wall and thereby closing a lower end of the receptacle.

48. The method of forming collapsible receptacles according to claim 47 further characterized by the steps of:

securing a pair of spaced apart, semicircular lift fork receiving members between a pair of fabric layers to provide a lift fork receiving bottom wall construction; and securing the lift fork receiving bottom wall construction to the lower end of the tubular receptacle side wall to close the bottom of the tubular receptacle.

49. A method of forming tubular receptacles comprising:

forming a recentangular piece of fabric into a tubular receptacle side wall;

securing a fabric top wall to the upper end of the tubular receptacle side wall to close the upper end of the receptacle;

securing a fabric bottom wall to the lower end of the tubular receptacle side wall to close the lower end of the receptacle;

providing a length of fabric material having a length at least as long as the circumference of the tubular receptacle side wall;

providing a length of webbing material;

securing the length of webbing material to the length of fabric material in the form of a plurality of substantially equally sized, substantially equally spaced lift loops;

said step of securing the length of webbing material to the fabric material being characterized by securing the opposite ends of each loop through the length of fabric material at a predetermined angle with respect to a line extending normal to the longitudinal axis of the length of fabric material and with the central portion of each lift loop unattached and extending above the upper edge of the length of fabric material; and subsequently securing the length of fabric material having the length of webbing material previously secured thereto to the upper portion of the tubular receptacle side wall with the unattached central portions of the lift loops extending above the upper edge of the tubular receptacle side wall.

50. The method of making collapsible receptacles according to claim 41 wherein the length of webbing material is twisted one half turn within the unattached central portion of each lift loop.

51. The method of making collapsible receptacles according to claim 42 wherein the length of webbing material is folded at the point of intersection of the attached end portions of adjacent lift loops.

52. The method of making collapsible receptacles according to claim 41 wherein each attached end portion of each lift loop is at least partially secured to the length of fabric material by means of an adhesive bond therebetween.

53. The method of making collapsible receptacles according to claim 41 wherein each attached end portion of each lift loop is at least partially secured to the length of fabric material by means of stitching.

54. The method of making collapsible receptacles according to claim 41 wherein each attached end portion of each lift loop is secured to the length of fabric material by means of an adhesive bond therebetween and by means of stitching.

55. A collapsible receptacle comprising:

a tubular receptacle side wall formed from fabric and having a predetermined circumference;

a length of fabric material having a length at least as long as the circumference of the tubular receptacle side wall and secured to the upper portion of the tubular receptacle side wall;

a length of webbing material secured to the length of fabric material in the form of a series of substantially equally sized, substantially equally spaced lift loops;

each of the lift loops comprising the length of webbing material including attached portions at the opposite ends thereof and an unattached central portion extending above the upper end of the tubular receptacle side wall; and each end portion of each lift loop comprising the length of webbing material being secured to the length of fabric material at a predetermined angle with respect to a line extending normal to the longitudinal axis of the length of fabric material.

56. The collapsible receptacle according to claim 55 further characterized by adhesive positioned between each attached end portion of each lift loop and fabric material for at least partially securing the length of webbing material to the length of fabric material.

57. The collapsible receptacle according to claim 55 further characterized by at least one line of stitching extending through each attached end portion of each lift loop for at least partially securing the length of webbing material to the length of fabric material.

58. The collapsible receptacle according to claim 55 further characterized by:

adhesive positioned between and mechanically connecting each attached end portion of each lift loop and the length of fabric material for partially securing the length of webbing material to the length of fabric material; and at least one line of stitching mechanically connecting each attached end portion of each lift loop and the length of fabric material for partially securing the length of webbing material to the length of fabric material.

59. The collapsible receptacle according to claim 55 wherein the unattached central portion of each lift loop is twisted one half turn.

60. The collapsible receptacle according to claim 55 wherein the length of webbing material is folded at the point of intersection of adjacent attached end portions of adjacent lift loops comprising the length of webbing material.

61. The collapsible receptacle according to claim 55 wherein the unattached central portion of each lift loop is twisted one half time, and wherein the length of webbing material is folded at the point of intersection of adjacent attached end portions of adjacent lift loops.

62. The collapsible receptacle according to claim 55 further including:

a fabric top wall secured to the upper end of the tubular receptacle side wall for closing the upper end of the receptacle; and a fabric bottom wall secured to the lower end of the tubular receptacle side wall for closing the lower end of the receptacle.

63. The collapsible receptacle according to claim 62 further characterized by a pair of spaced apart, semicircular lift fork receiving members secured in the fabric bottom wall for receiving lift forks therein.

* * * * *